US012061006B2

(12) United States Patent
Kitagawa et al.

(10) Patent No.: US 12,061,006 B2
(45) Date of Patent: Aug. 13, 2024

(54) AIR FLOW CONTROL APPARATUS

(71) Applicant: DAIKIN INDUSTRIES, LTD., Osaka (JP)

(72) Inventors: Keita Kitagawa, Osaka (JP); Youichi Handa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 682 days.

(21) Appl. No.: 17/270,370

(22) PCT Filed: Sep. 2, 2019

(86) PCT No.: PCT/JP2019/034417

§ 371 (c)(1),
(2) Date: Feb. 22, 2021

(87) PCT Pub. No.: WO2020/050214

PCT Pub. Date: Mar. 12, 2020

(65) Prior Publication Data

US 2021/0318018 A1 Oct. 14, 2021

(30) Foreign Application Priority Data

Sep. 3, 2018 (JP) ..... 2018-164961

(51) Int. Cl.
*F24F 11/77* (2018.01)
*F24F 11/56* (2018.01)
(Continued)

(52) U.S. Cl.
CPC ..... *F24F 11/77* (2018.01); *F24F 11/56* (2018.01); *F24F 11/63* (2018.01); *F24F 11/79* (2018.01); *F24F 2120/12* (2018.01)

(58) Field of Classification Search
CPC .. F24F 11/56; F24F 11/63; F24F 11/77; F24F 11/79; F24F 2120/12
(Continued)

(56) References Cited

U.S. PATENT DOCUMENTS 10,670,285 B2 * 6/2020 Subban ..... F24F 3/0442
10,871,302 B2 * 12/2020 Song ..... F24F 11/64
(Continued)

FOREIGN PATENT DOCUMENTS

CN 207146848 U 3/2018
JP 7-271426 A 10/1995
(Continued)

OTHER PUBLICATIONS

International Search Report of corresponding PCT Application No. PCT/JP2019/034417 dated Oct. 15, 2019.
(Continued)

*Primary Examiner* — Avinash A Savani
*Assistant Examiner* — Dana K Tighe
(74) *Attorney, Agent, or Firm* — Global IP Counselors, LLP

(57) ABSTRACT

An air flow control apparatus controls a fan. The air flow control apparatus includes an acquisition section, a detection section, and a control section. The acquisition section acquires image data obtained by an image capturing device installed in a target space. The detection section detects a specific object movable by an air flow sent from the fan, based on the image data acquired by the acquisition section. The control section executes first processing. The first processing includes controlling at least one of a direction and a volume of an air flow sent from the fan, based on a result of detection by the detection section.

15 Claims, 23 Drawing Sheets

(51) Int. Cl.
*F24F 11/63* (2018.01)
*F24F 11/79* (2018.01)
*F24F 120/12* (2018.01)

(58) Field of Classification Search
USPC ..... 454/256
See application file for complete search history.

(56) References Cited

U.S. PATENT DOCUMENTS

2003/0127527 A1 7/2003 Ichishi et al.
2014/0041145 A1* 2/2014 Matsumoto ..... A47L 9/2894 901/1
2014/0277757 A1* 9/2014 Wang ..... F24F 11/46 700/276
2015/0226449 A1* 8/2015 Larsson ..... F24F 7/065 454/256
2016/0150925 A1* 6/2016 Takei ..... F24F 8/10 15/301

FOREIGN PATENT DOCUMENTS

JP 9-184649 A 7/1997
JP 2003-205724 A 7/2003
JP 2007-57231 A 3/2007
JP 2017-122539 A 7/2017
JP 2018-76974 A 5/2018
JP 2019-128127 A 8/2019

OTHER PUBLICATIONS

International Preliminary Report of corresponding PCT Application No. PCT/JP2019/034417 dated Mar. 18, 2021.
European Search Report of corresponding EP Application No. 19 858 380.9 dated Aug. 13, 2021.

* cited by examiner

TB1 (D1)

| IMAGE CAPTURING UNIT ID | COMMUNICATION ADDRESS | INSTALLED SPACE | INSTALLED STATE | |
|---|---|---|---|---|
| 0120 | 172. 16. **. 01 | SP1 | INCORPORATED IN INDOOR UNIT 20a | |
| 0121 | 172. 16. **. 02 | SP2 | INCORPORATED IN INDOOR UNIT 20b | |
| 0122 | 172. 16. **. 03 | SP3 | INCORPORATED IN INDOOR UNIT 20c | |
| 0123 | 172. 16. **. 04 | SP4 | INCORPORATED IN INDOOR UNIT 20d | |
| 0124 | 172. 16. **. 05 | SP5 | INCORPORATED IN INDOOR UNIT 20e | |
| 0125 | 172. 16. **. 06 | SP6 | INCORPORATED IN INDOOR UNIT 20f | |
| | | | | |

FIG. 7

TB2 (D2)

| | ARTICLE | CATEGORY | BELONGING GROUP | CHARACTERISTIC |
|---|---|---|---|---|
| X1 | DOCUMENT | PAPER | G2 | ○○○○○ |
| X1 | SHICHIRIN | SOOT | G1 | × × × × |
| X1 | ASHTRAY | ASH | G1 | ▲▲▲ |
| X1 | PLANT | LEAF | G3 | □□□□ |
| X1 | TRASH BAG | SYNTHETIC FIBER | G4 | △△△△ |
| X1 | SLIP | PAPER | G1 | ☆☆☆ |
| X1 | DUSTPAN | DUST, DIRT | G1 | ★★★ |
| | ⋮ | ⋮ | ⋮ | ⋮ |
| X1 | CURTAIN | VEIL | G5 | ◎◎◎◎ |
| | | | | |

FIG. 8

TB3 (D4)

| OBJECT ID | NAME (ARTICLE) | CATEGORY | LOCATED SPACE | LOCATED POSITION | DISTANCE FROM BLOW-OUT PORT | LOCATED DATE AND TIME |
|---|---|---|---|---|---|---|
| 3586912 | PC1 | LAPTOP PC | SP2 | (192,113,65) | 1800mm | 2018/03/05/17:55 |
| 2056651 | PC2 | DESKTOP PC | SP2 | (255,333,0) | 1950mm | 2018/03/05/17:55 |
| 1822013 | MULTI FUNCTION PERIPHERAL1 | FLOORSTANDING MULTI FUNCTION PERIPHERAL | SP2 | (102,373,0) | 2550mm | 2018/03/05/17:55 |
| 2056651 | TELEPHONE1 | TELEPHONE | SP2 | (123,383,65) | 1850mm | 2018/03/05/17:55 |
| 5678921 | DOCUMENT1 | PAPER | SP2 | (120,112,0) | 1650mm | 2018/03/05/17:55 |
| 5766598 | DOCUMENT2 | PAPER | SP2 | (125,110,69) | 2050mm | 2018/03/05/17:55 |
| 5922038 | ASHTRAY1 | ASH | SP2 | (250,240,61) | 2850mm | 2018/03/05/17:55 |
| ⋮ | ⋮ | ⋮ | ⋮ | ⋮ | ⋮ | ⋮ |
| 9065893 | PAPER CUP1 | PAPER | SP2 | (289,313,65) | 1750mm | 2018/03/05/17:55 |
| 01139 | PERSON1 | HUMAN | SP2 | (195,101,51) | 1450mm | 2018/03/05/17:55 |
| 01252 | PERSON2 | HUMAN | SP2 | (250,253,11) | 1900mm | 2018/03/05/17:55 |
| | | | | | | |

FIG. 9

TB4 (D5)

| | OBJECT ID | NAME (ARTICLE) | CATEGORY | LOCATED SPACE | LOCATED POSITION | DISTANCE FROM BLOW-OUT PORT | LOCATED DATE AND TIME |
|---|---|---|---|---|---|---|---|
| X2 | 5678921 | DOCUMENT1 | PAPER | SP2 | (120,112,0) | 1650mm | 2018/03/05/17:55 |
| X2 | 5766598 | DOCUMENT2 | PAPER | SP2 | (125,110,69) | 2050mm | 2018/03/05/17:55 |
| X2 | 9065893 | PAPER CUP1 | PAPER | SP2 | (289,313,65) | 1750mm | 2018/03/05/17:55 |
| X2 | ***** | ****** | ****** | *** | ******** | | ********** |
| | ⋮ | ⋮ | ⋮ | ⋮ | ⋮ | | ⋮ |
| | | | | | | | |

FIG. 10

TB5(D6)

| | OBJECT ID | NAME (ARTICLE) | CATEGORY | LOCATED SPACE | LOCATED POSITION | DISTANCE FROM BLOW-OUT PORT | LOCATED DATE AND TIME | |
|---|---|---|---|---|---|---|---|---|
| X3 | 5678921 | DOCUMENT1 | PAPER | SP2 | (120,112,0) | 1650mm | 2018/03/05/17:55 | |
| X3 | 5766598 | DOCUMENT2 | PAPER | SP2 | (125,110,69) | 2050mm | 2018/03/05/17:55 | |
| | | | | | | | | |

FIG. 11

TB6(D8)

| | OBJECT ID | LOCATED SPACE | LOCATED POSITION | DISTANCE FROM BLOW-OUT PORT | LOCATED DATE AND TIME | LIMIT AIR FLOW DIRECTION AND LIMIT AIR FLOW VOLUME | |
|---|---|---|---|---|---|---|---|
| X3 | 5678921 | SP2 | (120,112,0) | 1650mm | 2018/03/05/17:55 | AIR FLOW DIRECTION1: MINIMUM AIR FLOW VOLUME<br>AIR FLOW DIRECTION2: MIDDLE AIR FLOW VOLUME<br>AIR FLOW DIRECTION4: LARGE AIR FLOW VOLUME<br>⋮ | |
| X3 | 5766598 | SP2 | (125,110,69) | 2050mm | 2018/03/05/17:55 | AIR FLOW DIRECTION1: —<br>AIR FLOW DIRECTION2: MINIMUM AIR FLOW VOLUME<br>AIR FLOW DIRECTION3: MIDDLE AIR FLOW VOLUME<br>⋮ | |
| | | | | | | | |

FIG. 12

AIR FLOW CONTROL APPARATUS

CROSS-REFERENCE TO RELATED APPLICATIONS

This U.S. National stage application claims priority under 35 U.S.C. § 119(a) to Japanese Patent Application No. 2018-164961, filed in Japan on Sep. 3, 2018, the entire contents of which are hereby incorporated herein by reference.

BACKGROUND

Field of the Invention

The present disclosure relates to an air flow control apparatus or relates to an air conditioner or an air flow control system including the air flow control apparatus.

Background Information

There is a fan installed in a target space and configured to generate an air flow. For example, JP 2018-76974 A discloses an idea of a fan for appropriately controlling an air flow to be sent through a blow-out port.

SUMMARY

In a target space where a fan is installed, there may be an object movable by an air flow which the fan sends. For example, paper, ash, soot, dust, dirt, and others may be blown off by an air flow which the fan sends, against user's will.

A first aspect provides an air flow control apparatus for controlling a fan, the air flow control apparatus including an acquisition section, a detection section, and a control section. The acquisition section is configured to acquire image data. The image data is information containing an image of a target space captured by an image capturing device. The image capturing device is installed in a target space. The detection section is configured to detect a specific object, based on the image data acquired by the acquisition section. The specific object is an object movable by an air flow which the fan sends. The control section is configured to execute first processing. The first processing is processing of controlling at least one of a direction or a volume of an air flow which the fan sends, based on a result of detection by the detection section. According to this configuration, the air flow control apparatus detects a specific object (an object movable by an air flow which the fan sends) from an image captured by the image capturing device in the target space, and makes it possible to control at least one of the direction or the volume of the air flow which the fan sends, so as to inhibit the specific object from being moved against user's will.

As used herein, the "fan" is not limited as long as it is a device configured to send an air flow. Examples of the "fan" may include an indoor unit of an air conditioner, an air cleaner, a dehumidifier, an electric fan, and a ventilator.

As used herein, the "image data" contains information on at least any of a still image or a moving image.

As used herein, the "specific object" refers to an object that is supposed to be moved by an air flow which the fan sends, against user's will. Specifically, the "specific object" refers to an object that is moved by an air flow of which a volume is equal to or less than a maximum volume of an air flow which the fan sends. Examples of the "specific object" may include paper, cloth, fiber, a veil, ash, soot, dust, and dirt.

As used herein, the state "movable by the air flow which the fan sends" involves any of or all of a state in which an object is actually moved by an air flow which the fan sends and a state in which an object is possibly moved by an air flow which the fan sends. More specifically, the "specific object" involves any of or all of an object that is actually moved by an air flow which the fan sends, an object that is possibly moved by an air flow which the fan sends, and an object that is registered in advance as an object supposed to be moved by an air flow which the fan sends. As used herein, the state "moved" involves at least any of a state "flown", a state "shifted", a state "vibrated", and a state "swayed".

A second aspect provides the air flow control apparatus according to the first aspect, wherein the first processing includes controlling at least one of the direction or the volume of the air flow which the fan sends such that the specific object is not moved by the air flow which the fan sends.

A third aspect provides the air flow control apparatus according to the first or second aspect, wherein the first processing includes reducing the volume of the air flow which the fan sends to the specific object. As used herein, the state "reducing the volume of the air flow which the fan sends to the specific object" involves any of or all of a state of reducing a volume of an air flow from the fan to weaken the air flow which the fan sends to the specific object and a state of changing a direction of an air flow which the fan sends to the specific object to weaken the air flow which the fan sends to the specific object. According to this configuration, the air flow control apparatus makes it possible to control the fan such that the specific object is not moved by an air flow which the fan sends.

A fourth aspect provides the air flow control apparatus according to any of the first to third aspects, wherein the detection section detects a position of the specific object relative to the fan. As used herein, "the position of the specific object relative to the fan" involves any of or all of a position of the specific object relative to a main body of the fan and a position of the specific object relative to a blow-out port in the fan. According to this configuration, the air flow control apparatus makes it possible to execute the first processing more accurately by grasping the position of the specific object relative to the fan.

A fifth aspect provides the air flow control apparatus according to the fourth aspect, wherein the detection section detects a distance between the fan and the specific object. As used herein, "the distance between the fan and the specific object" involves any of or all of a distance between the main body of the fan and the specific object and a distance between the blow-out port in the fan and the specific object. According to this configuration, the air flow control apparatus makes it possible to execute the first processing more accurately by grasping the distance between the fan and the specific object in the first processing.

A sixth aspect provides the air flow control apparatus according to any of the first to fifth aspects, further including a storage section. The storage section is configured to store object information. The object information is information on the specific object. The detection section detects the specific object, based on the object information stored in the storage section. According to this configuration, the air flow control apparatus makes it possible to execute the first processing on the object more reliably by optionally registering the information on the specific object to be subjected to the first processing in advance.

As used herein, the "storage section" involves any of or all of a main storage section configured to temporarily store object data and a large-capacity auxiliary storage section configured to accumulate object data.

As used herein, the "object information" refers to information on a specific object. The "object information" is not limited as long as it is information to be used in detecting a specific object. The "object information" is, for example, information identifying at least any of an article, a category, a shape, another characteristic, and the like as to a specific object.

A seventh aspect provides the air flow control apparatus according to the sixth aspect, wherein the specific object includes at least any of paper, cloth, fiber, a veil, ash, soot, dust, or dirt. According to this configuration, the air flow control apparatus makes it possible to execute the first processing on an object as to which the user does not desire that the object is moved by an air flow which the fan sends.

An eighth aspect provides the air flow control apparatus according to the sixth or seventh aspect, further including a learning section. The learning section is configured to learn about the first processing. The learning section learns about at least one of the volume or the volume of the air flow by which the specific object is inhibited from being moved, based on a result of the first processing executed. Since the learning section learns about the first processing, the first processing is executed with improved accuracy on the specific object in the target space. The air flow control apparatus reliably inhibits the specific object from being moved.

A ninth aspect provides the air flow control apparatus according to any of the sixth to eighth aspects, further including an update section. The update section is configured to update the object information. According to this configuration, the air flow control apparatus makes it possible to update the information on the specific object to be subjected to the first processing appropriately.

A tenth aspect provides the air flow control apparatus according to any of the first to ninth aspects, wherein the detection section further detects a person in the target space, based on the image data acquired by the acquisition section. According to this configuration, the air flow control apparatus makes it possible to achieve fine control while taking a relationship between the specific object and the person into consideration.

An eleventh aspect provides an air conditioner including the air flow control apparatus according to any of the first to tenth aspects. According to this configuration, in an air blowing operation, the air conditioner makes it possible to control at least one of the direction or the volume of the air flow so as to inhibit the specific object from being moved against user's will.

A twelfth aspect provides an air flow control system including a fan, an image capturing device, and the air flow control apparatus according to any of the first to tenth aspects. The image capturing device is installed in a target space.

BRIEF DESCRIPTION OF DRAWINGS

FIG. 7 is a schematic diagram of an image capturing unit table which is an example of image capturing unit installation data.

FIG. 8 is a schematic diagram of a target object table which is an example of target object data.

FIG. 9 is a schematic diagram of a detection table which is an example of detection data.

FIG. 10 is a schematic diagram of a kinetic object table which is an example of kinetic object data.

FIG. 11 is a schematic diagram of a specific object table which is an example of specific object data.

FIG. 12 is a schematic diagram of an air flow direction and air flow volume table which is an example of learning data.

DETAILED DESCRIPTION OF EMBODIMENT(S)

Embodiments of the present disclosure will be described below. It should be noted that the following embodiments are merely specific examples, do not intend to limit the technical scope, and may be appropriately modified without departing from the spirit.

First Embodiment (1) Air Conditioning System 100 (Air Flow Control System)

Figure 1:
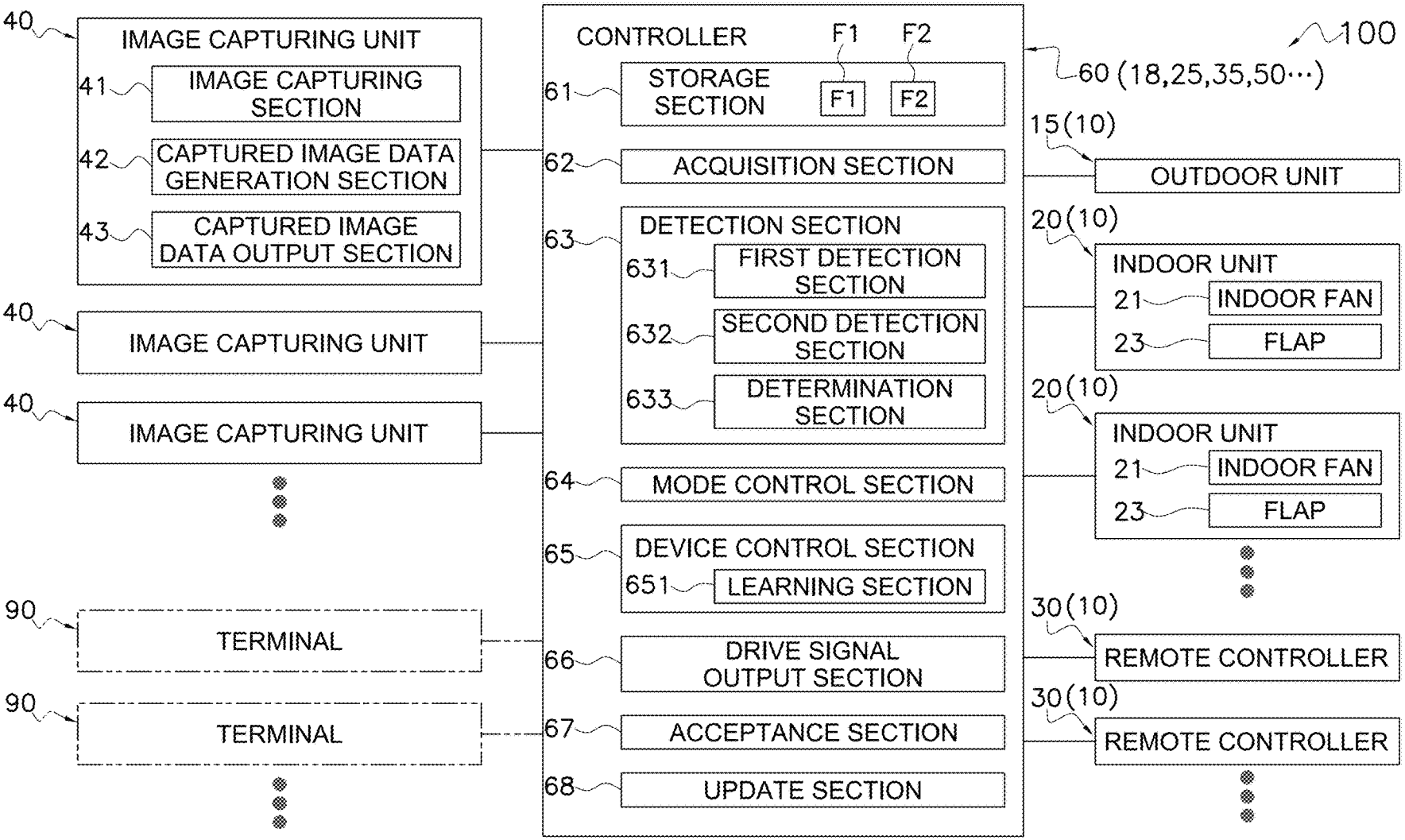
FIG. 1 is a block diagram of a schematic configuration of an air conditioning system according to a first embodiment.
Figure 2:
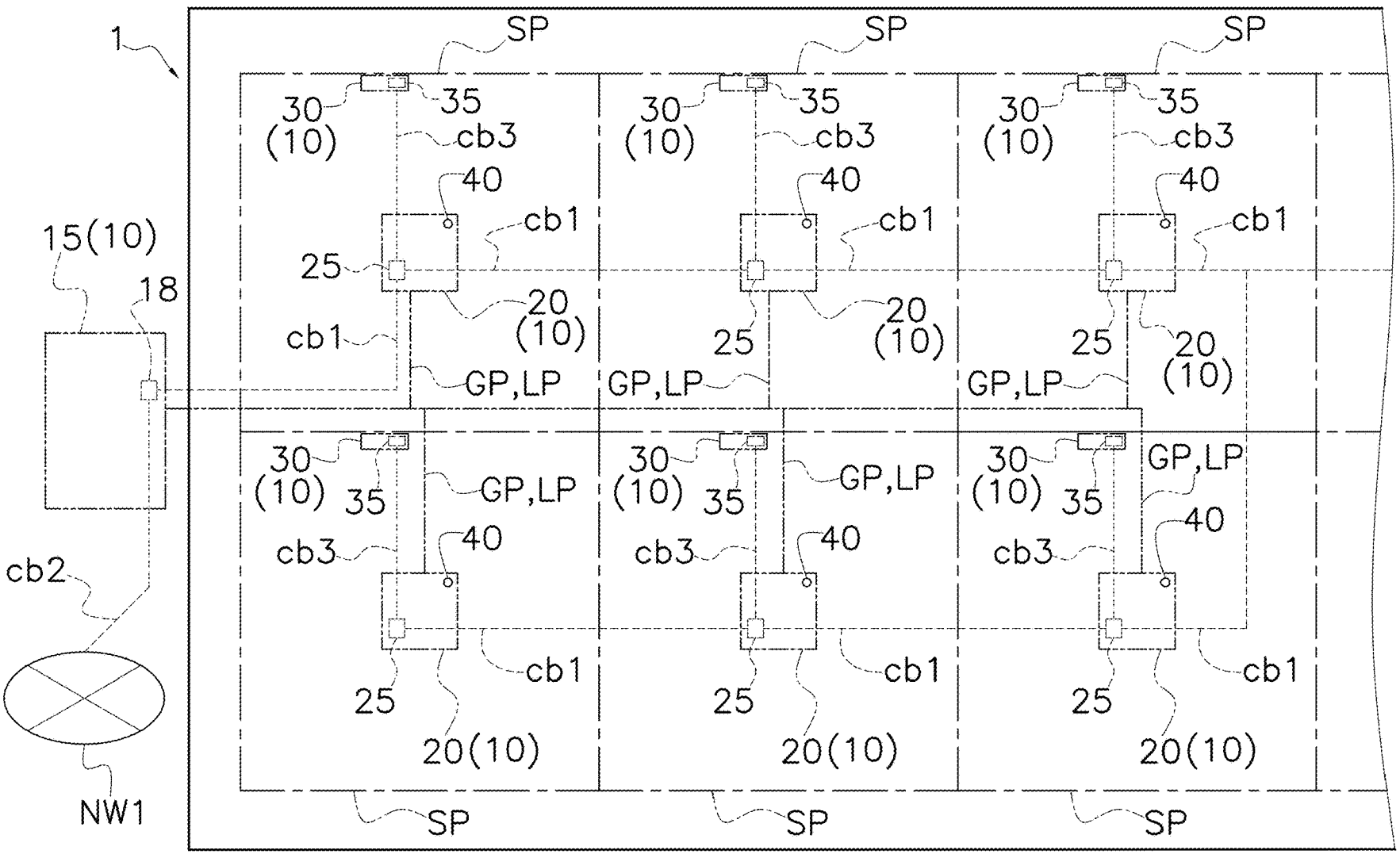
FIG. 2 is a schematic diagram of exemplary installation of devices in a target facility.

FIG. 1 is a block diagram of a schematic configuration of an air conditioning system 100. FIG. 2 is a schematic diagram of exemplary installation of devices in a target facility 1. The air conditioning system 100 is a system for performing air conditioning in a target space SP. The air conditioning system 100 captures an image of the interior of the target space SP, detects a specific object X3 that is possibly moved by an air flow which a fan (an indoor unit 20) sends during an operation, based on the captured image, and controls the air flow so as to inhibit the specific object X3 from being moved.

Figure 3:
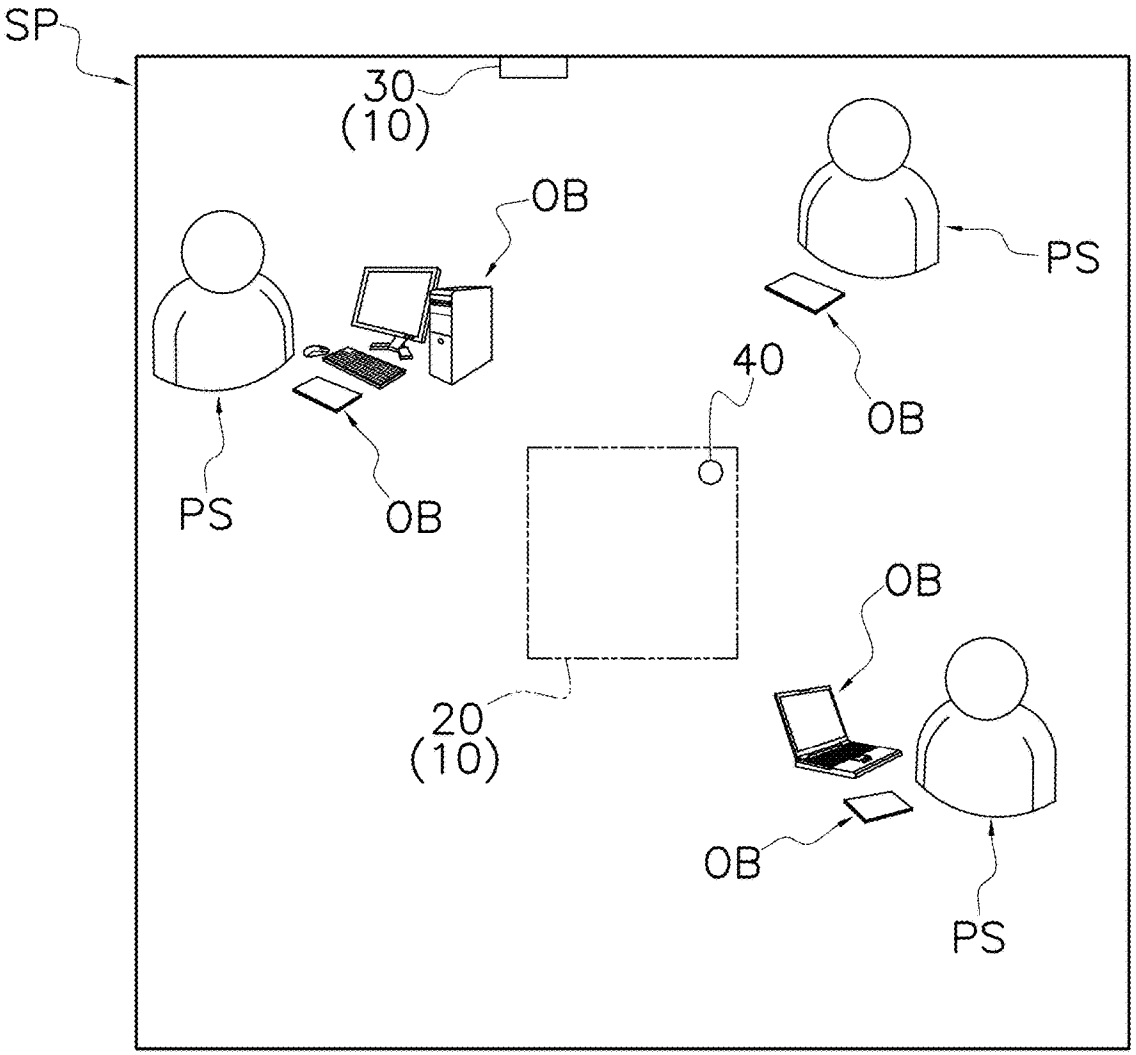
FIG. 3 is a schematic diagram of an exemplary target space.

In the first embodiment, the air conditioning system 100 is applied to the target facility 1. The target facility 1 includes the target space SP. In the first embodiment, the target facility 1 includes a plurality of the target spaces SP. As illustrated in, for example, FIG. 3, each of the target spaces SP is a space where a person PS performs an activity, and is a space to be used as, for example, an office. Each of the target spaces SP is not limited to an office. For example, each of the target spaces SP may be used as a commercial facility such as a restaurant, a school, a factory, a hospital, or a residence. In the first embodiment, examples of the person PS may include a person who works at the target facility 1, a person who learns something in the target facility 1, a person who lives in the target facility 1, and a visitor who visits the target facility 1. In the first embodiment, examples of an object OB may include a personal property of the person PS, a property for common use, and a piece of equipment in the target facility 1.

The air conditioning system 100 mainly includes an air conditioner 10, a plurality of image capturing units 40, and a controller 60.

(1-1) Air Conditioner 10

The air conditioner 10 is an apparatus that achieves air conditioning operations such as a cooling operation and a heating operation in the target spaces SP. The air conditioner 10 cools or heats the interiors of the target spaces SP through a vapor compression refrigeration cycle in a refrigerant circuit.

The air conditioner 10 mainly includes an outdoor unit 15 serving as a heat source unit, a plurality of indoor units 20 each serving as a usage unit, and a plurality of remote controllers 30. The number of outdoor units 15, indoor units 20 and remote controllers 30 in the air conditioner 10 is not limited and can be changed as appropriate. For example, the air conditioner 10 may include a plurality of the outdoor units 15. The air conditioner 10 may include only one of the indoor unit 20. The air conditioner 10 may include only one of the remote controller 30. In the air conditioner 10, the outdoor unit 15 and the indoor units 20 are connected via gas connection pipes GP and liquid connection pipes LP to constitute the refrigerant circuit.

(1-1-1) Outdoor Unit 15

The outdoor unit 15 is installed outside the target spaces SP. The outdoor unit 15 mainly includes, as constituent elements of the refrigerant circuit, a plurality of refrigerant pipes, a compressor, an outdoor heat exchanger, an expansion valve, and the like (not illustrated). The outdoor unit 15 also includes various sensors such as a temperature sensor and a pressure sensor, and devices such as a fan.

The outdoor unit 15 also includes an outdoor unit control section 18 that controls operations of various actuators in the outdoor unit 15. The outdoor unit control section 18 includes a microcomputer including memories such as a RAM and a ROM and a CPU, a communication module, various electronic components, and various electric components. The outdoor unit control section 18 is electrically connected to the various actuators and sensors via wires.

The outdoor unit control section 18 is connected to an indoor unit control section 25 (to be described later) of each indoor unit 20 via a communication line cb1 to exchange signals with the indoor unit control section 25. The outdoor unit control section 18 is also connected to a wide area network NW1 including a WAN (Wide Area Network) such as the Internet via a communication line cb2 to exchange signals with a device (e.g., a server 50) connected to the wide area network NW1.

(1-1-2) Indoor Unit 20 (Fan)

Figure 4:
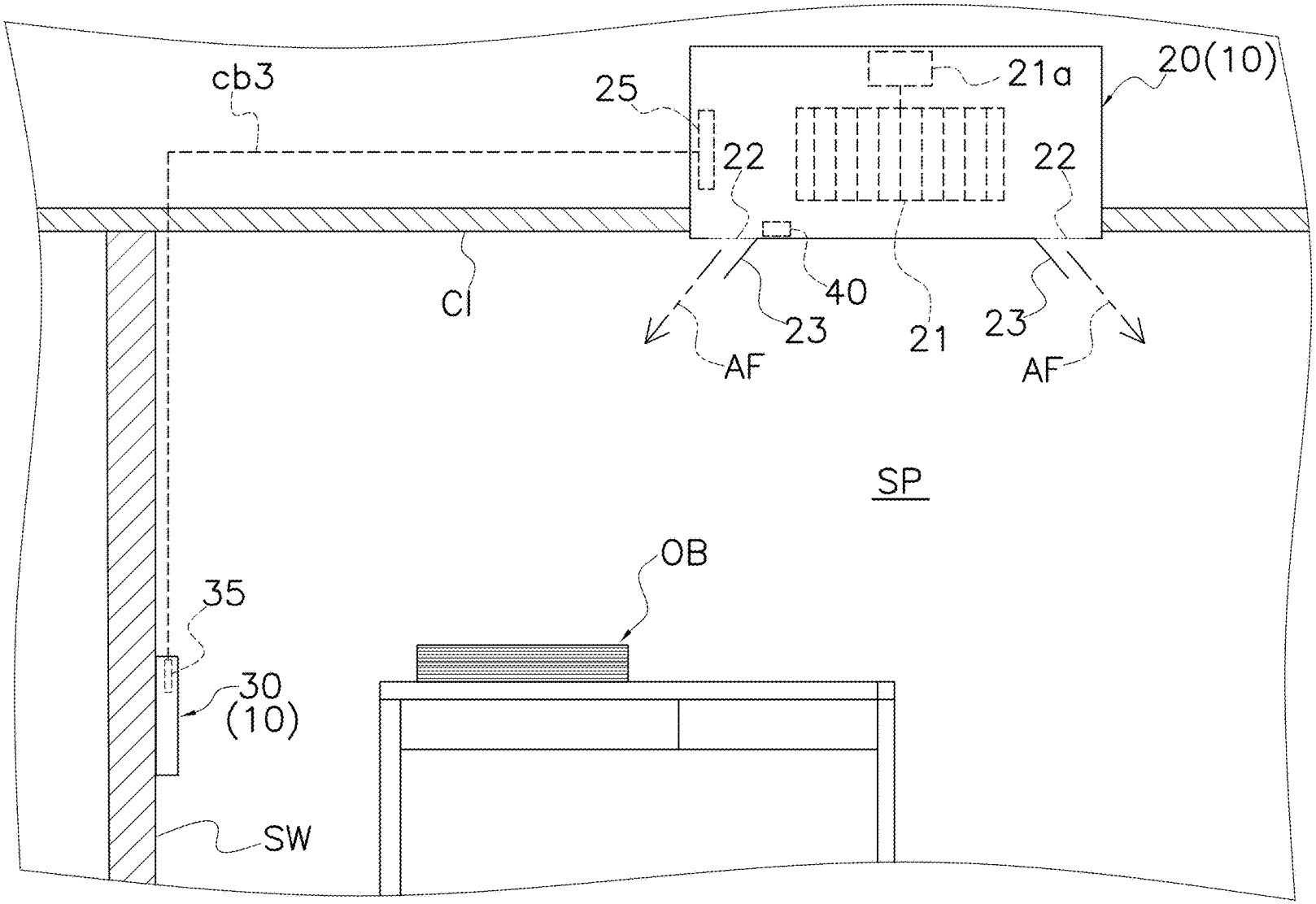
FIG. 4 is a schematic diagram of exemplary installation of devices and objects in a target space.

Each of the indoor units 20 is a ceiling-embedded air conditioning indoor unit to be installed on a ceiling CI of the corresponding target space SP or a ceiling-suspended air conditioning indoor unit to be installed near the ceiling CI. FIG. 4 is a schematic diagram of exemplary installation of devices in any one of the target spaces SP. As illustrated in FIG. 4, the indoor unit 20 is installed in the target space SP such that a main body thereof is partially exposed from the ceiling CI, for example, a decorative panel, a flap 23, and the like are exposed from the ceiling CI. The indoor unit 20 includes, as constituent elements of the refrigerant circuit, an indoor heat exchanger, an indoor expansion valve, and the like. The indoor unit 20 also includes various sensors such as pressure sensors and temperature sensors for detecting a temperature in the target space SP and a temperature of a refrigerant.

The indoor unit 20 includes an indoor fan 21 that generates an air flow to be sent toward the target space SP. The air flow which the indoor unit 20 sends is referred to as an indoor air flow AF. The indoor fan 21 includes an indoor fan motor 21*a* serving as a drive source, and rotates in conjunction with the indoor fan motor 21*a*. The number of rotations of the indoor fan motor 21*a* is controlled as appropriate. The indoor fan motor 21*a* is, for example, a motor controllable by an inverter. A volume of the indoor air flow AF is changed in accordance with the number of rotations of the indoor fan 21. The number of rotations of the indoor fan 21 is controlled by the indoor unit control section 25.

A blow-out port 22 through which the indoor air flow AF is blown out is formed in the indoor unit 20. The blow-out port 22 in the indoor unit 20 communicates with the target space SP.

The indoor unit 20 includes the flap 23 for adjusting a direction of the indoor air flow AF blown out through the blow-out port 22. The flap 23 is a plate-shaped member that opens and closes the blow-out port 22. The flap 23 is pivotable about at least one of a horizontal axis or a vertical axis. The flap 23 includes a drive source such as a stepping motor so that open and closed angles are controllable. The flap 23 pivots to change the direction of the indoor air flow AF. The operation and orientation of the flap 23 are controlled by the indoor unit control section 25.

The indoor unit 20 includes the indoor unit control section 25 that controls the operations of various actuators (e.g., the indoor fan 21, the flap 23) in the indoor unit 20. The indoor unit control section 25 includes a microcomputer including memories such as a RAM and a ROM and a CPU, a communication module, various electronic components, and various electric components. The indoor unit control section 25 is electrically connected to various actuators and various sensors via wires to exchange signals with the various actuators and sensors. The indoor unit control section 25 is connected to the outdoor unit control section 18 or the other indoor unit control sections 25 via the communication line cb1 to exchange signals with the outdoor unit control section 18 or the other indoor unit control sections 25. The indoor unit control section 25 is also connected to a remote controller control section 35 (to be described later) of the corresponding remote controller 30 via a communication line cb3 to exchange signals with the remote controller control section 35. The indoor unit control section 25 is also connected to the corresponding image capturing unit 40 via a communication line cb4 (FIG. 5) to exchange signals with the image capturing unit 40.

(1-1-3) Remote Controller 30

The remote controllers 30 and the indoor units 20 are provided in one-to-one correspondence. Each of the remote controllers 30 is hung on a sidewall SW of the target space SP where the corresponding indoor unit 20 is installed. Each of the remote controllers 30 is, for example, a wired remote control apparatus that is connected to the corresponding indoor unit 20 (the indoor unit control section 25) via the communication line cb3. Each of the remote controllers 30 functions as an input apparatus through which the user inputs commands for various settings to the air conditioner 10. Each of the remote controllers 30 also functions as a display apparatus for displaying an operating state and setting items of the air conditioner 10. Each of the remote controllers 30 includes the remote controller control section 35 that controls the operation of the remote controller 30.

(1-2) Image Capturing Unit 40 (Image Capturing Device)

The air conditioning system 100 includes the plurality of image capturing units 40. Each of the image capturing units 40 is a unit that captures an image of the interior of the corresponding target space SP and generates and outputs data containing the captured image (captured image data D3). Each of the image capturing units 40 is installed in the corresponding target space SP. In the first embodiment, each of the image capturing units 40 is provided in the indoor unit 20 installed in the corresponding target space SP. That is, the image capturing unit 40 is located on the ceiling CI or near the ceiling CI (i.e., at a position closer to the ceiling CI than a floor surface).

Each of the image capturing units 40 includes an image capturing section 41, a captured image data generation section 42, and a captured image data output section 43. The image capturing section 41 includes an imaging element and a lens for capturing an image in a predetermined range of the corresponding target space SP (e.g., a fisheye lens or a fixed focal length lens; however, the lens is not limited thereto). The captured image data generation section 42 subjects an electric signal output from the imaging element of the image capturing section 41 to analog-to-digital conversion, and generates captured image data D3 in a predetermined format. The captured image data D3 contains image data (moving image data) in which a predetermined range of the target space SP is represented by predetermined pixels. In other words, the captured image data D3 is information containing an image of the target space SP captured by the image capturing unit 40 installed in the target space SP. The captured image data output section 43 compresses the captured image data D3 thus generated, and outputs the resultant captured image data D3 to the controller 60 (directly, the corresponding indoor unit control section 25).

(1-3) Controller 60 (Air Flow Control Apparatus)

Figure 5:
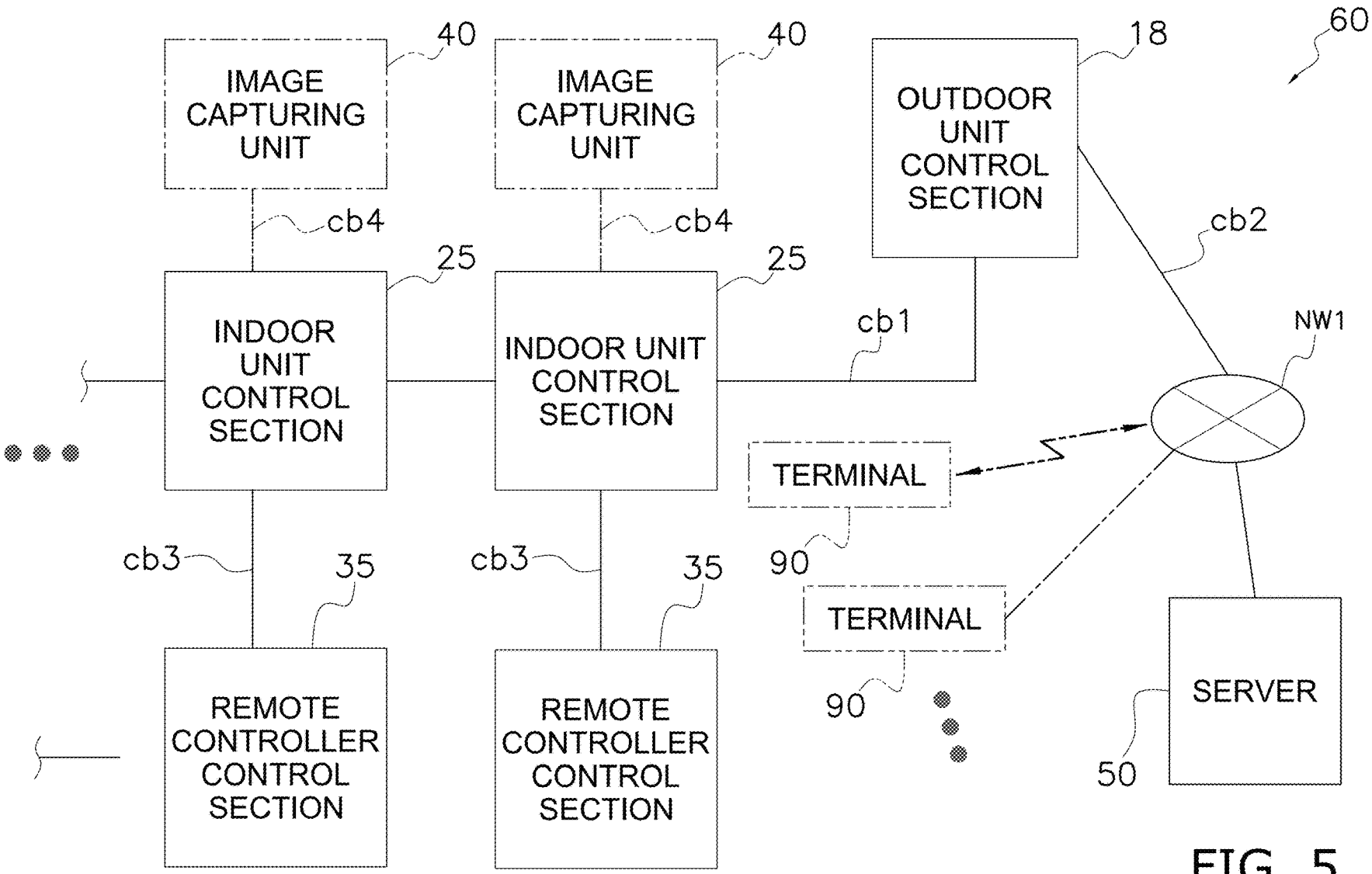
FIG. 5 is a schematic diagram of a configuration of a controller.

The controller 60 is a control apparatus that manages the operation of the air conditioning system 100 in a centralized manner. The controller 60 executes processing in accordance with a command input thereto. In the first embodiment, as illustrated in FIG. 5, the controller 60 is constituted of the outdoor unit control section 18, the indoor unit control sections 25, the remote controller control sections 35, and the server 50 that are connected via a communication network. In other words, the outdoor unit control section 18, the indoor unit control sections 25, the remote controller control sections 35, and the server 50 constitute the controller 60.

The server 50 is a computer that constitutes the controller 60 in conjunction with the outdoor unit control section 18, the indoor unit control sections 25, and the remote controller control sections 35 in the air conditioning system 100. The server 50 is installed at a position away from the target spaces SP. The server 50 is connected to the wide area network NW1 via a communication line, and is configured to establish communications with the outdoor unit control section 18, the indoor unit control sections 25, and the remote controller control sections 35 via the wide area network NW1.

The controller 60 exchanges data with the image capturing units 40 and terminals 90. The controller 60 executes processing based on captured image data D3. More specifically, the controller 60 individually detects a person PS and an object OB contained in the captured image data D3, and executes processing in accordance with a result of the detection.

(2) Terminal 90

The air conditioning system 100 is connectable to the terminals 90 via the wide area network NW1 or another local network. The terminals 90 are an information terminal of an administrator and an information terminal of a user. Examples of the terminals 90 may include mobile terminals such as a smartphone and a tablet PC, and personal computers such as a laptop PC. Alternatively, the terminals 90 may be any other information processing devices.

Each of the terminals 90 includes a communication module configured to establish communications with the other units. For example, the terminals 90 establish wireless communications or wire communications with the outdoor unit control section 18, the indoor unit control sections 25, the remote controller control sections 35, or the server 50.

Each of the terminals 90 includes an input section through which a command is input. In the air conditioning system 100, each of the terminals 90 is capable of functioning as a "command input section" through which a command is input. For example, each of the terminals 90 can be used to input a command to the controller 60 by installing a predetermined application program. The user can control the operations of the image capturing units 40 and the operation of the controller 60 as appropriate by inputting a command using the terminal 90.

Each of the terminals 90 also includes a display section for displaying (outputting) information. In the air conditioning system 100, each of the terminals 90 is capable of functioning as an "output section" from which information is output. The user is able to grasp an operating state of the air conditioning system 100 and a result of processing in the air conditioning system 100, through the terminal 90.

(3) Details of Controller 60

The controller 60 executes predetermined processing based on captured image data D3 of each image capturing unit 40. For example, the controller 60 detects a person PS and an object OB in any one of target spaces SP, based on the captured image data D3. The controller 60 also detects a specific object X3, based on the captured image data D3. The specific object X3 is an object OB movable by an air flow which the indoor unit 20 sends (an indoor air flow AF) against user's will. In the first embodiment, the state "movable by the air flow which the indoor unit 20 sends" involves any of or all of a state in which the object OB is actually moved by the air flow which the indoor unit 20 sends and a state in which the object OB is possibly moved by the air flow which the indoor unit 20 sends. In the first embodiment, the state "moved" involves at least any of a state "flown", a state "shifted", a state "vibrated", and a state "swayed".

The controller 60 has a plurality of control modes, and controls the operations of the respective devices in accordance with a control mode in which the controller 60 is to be placed. For example, the controller 60 controls the number of rotations of the indoor fan 21 and the angle of the flap 23 in accordance with a control mode. In other words, the controller 60 controls a volume and a direction of an air flow which the indoor unit 20 sends toward the target space SP, in accordance with a control mode.

In the first embodiment, the controller 60 has a first control mode and a second control mode as the plurality of control modes. The controller 60 is normally placed in the first control mode. In the first embodiment, the state "normally" refers to a case where no specific object X3 is detected in the target space SP. The controller 60 is placed in the second control mode when a specific object X3 is detected in the target space SP.

The controller 60 mainly includes functional sections such as a storage section 61, an acquisition section 62, a detection section 63, a mode control section 64, a device control section 65, a drive signal output section 66, an acceptance section 67, and an update section 68. Each of the functional sections is embodied in such a manner that any of or all of the devices constituting the controller 60 (in the first embodiment, the outdoor unit control section 18, each indoor unit control section 25, each remote controller control section 35, and the server 50) operates or operate. Each of or any of the outdoor unit control section 18, each indoor unit control section 25, each remote controller control section 35, and the server 50 includes each functional section. The controller 60 is configured to acquire a time of day on its own in real time or acquire a time of day from another apparatus in real time.

(3-1) Storage Section 61

The storage section 61 is constituted of memories such as a ROM, a RAM, a flash memory, and a hard disk in any of or all of the devices constituting the controller 60. The storage section 61 includes a plurality of storage regions such as a volatile storage region temporarily storing information and a nonvolatile storage region accumulating various kinds of information.

The storage section 61 is provided with a plurality of flags each including bits in a predetermined number. For example, the storage section 61 is provided with a kinetic object flag F1 capable of determining presence or absence of a kinetic object X2 in any one of the target spaces SP. For example, the storage section 61 is also provided with a control mode flag F2 capable of determining a control mode in which the controller 60 is to be placed. The control mode flag F2 includes bits in a number corresponding to the number of control modes, and the bits are set in accordance with a control mode in which the controller 60 is to be placed.

Figure 6:
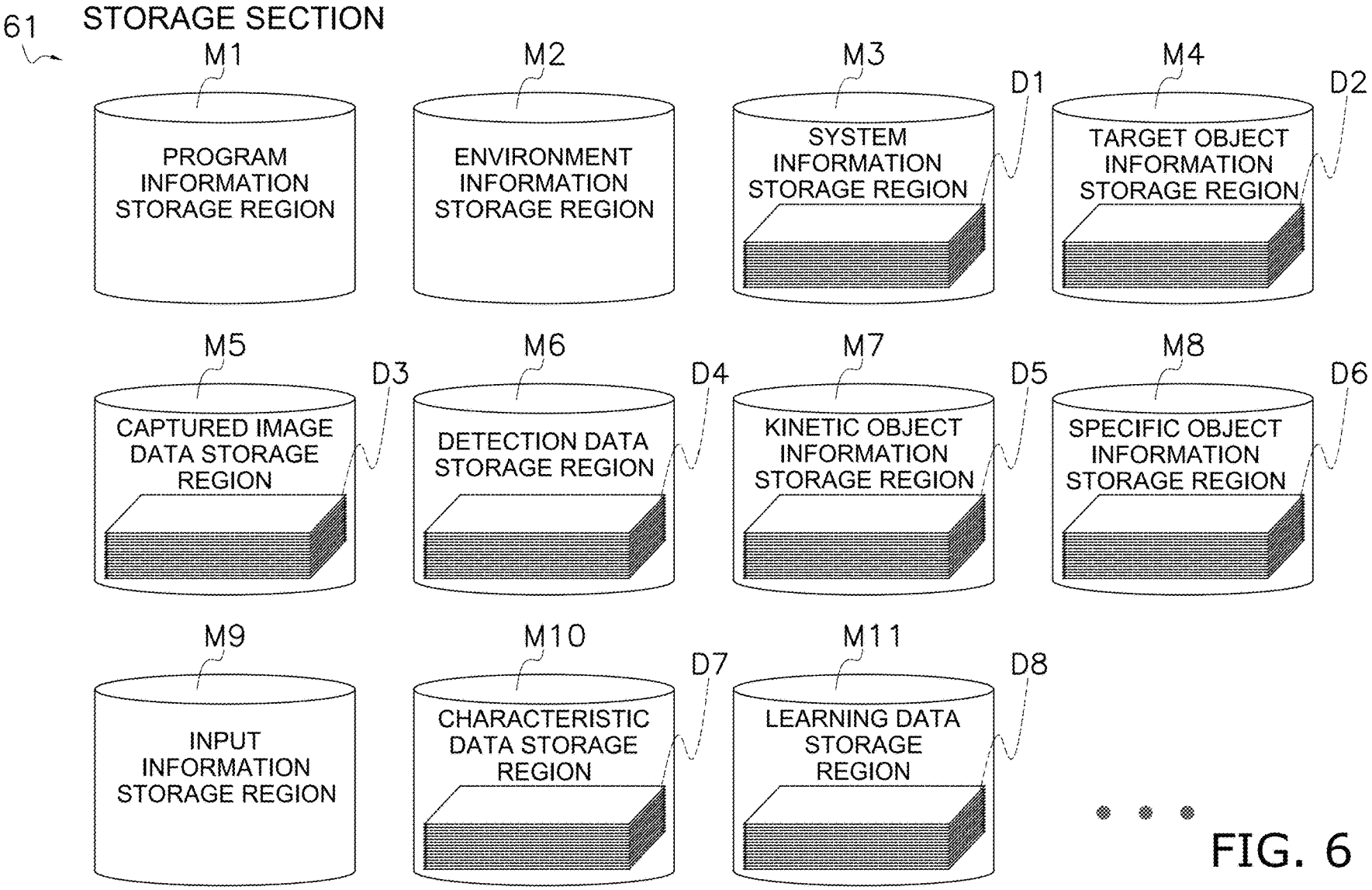
FIG. 6 is a schematic diagram of storage regions in a storage section.

As illustrated in FIG. 6, the storage section 61 includes the storage regions such as a program information storage region M1, an environment information storage region M2, a system information storage region M3, a target object information storage region M4, a captured image data storage region M5, a detection data storage region M6, a kinetic object information storage region M7, a specific object information storage region M8, an input information storage region M9, a characteristic data storage region M10, and a learning data storage region M11. Each storage region stores information that is updatable as appropriate.

The program information storage region M1 stores, for example, control programs defining various kinds of processing to be executed by the sections of the controller 60, and communication protocols for use in communications among the units. The control programs and the like stored in the program information storage region M1 are updatable as appropriate through the server 50, the terminals 90, and the like.

The environment information storage region M2 stores information on the target facility 1 (environment information). The environment information contains, for example, information individually identifying the number, positions, sizes, and the like of target spaces SP in the target facility 1.

The system information storage region M3 stores information on each device in the air conditioning system 100. For example, the system information storage region M3 stores information on each image capturing unit 40 installed in the target facility 1 (image capturing unit installation data D1). The image capturing unit installation data D1 contains information identifying an identification code (ID), a communication address, an installed position, an installed state, and the like of each image capturing unit 40 in the target facility 1. The image capturing unit installation data D1 is stored in the form of an image capturing unit table TB1 illustrated in, for example, FIG. 7. As illustrated in FIG. 7, referring to the image capturing unit table TB1, the image capturing unit 40 having an ID "0120" is identified as follows. For example, the communication address is "172.16..01", the installed space is "(target space) SP1", and the installed state is "incorporated in indoor unit 20***a*". It should be noted that the image capturing unit installation data D1 is not necessarily generated in the form illustrated in FIG. 7. The generation form of the image capturing unit installation data D1 is changeable as appropriate. For example, the image capturing unit installation data D1 may contain information identifying a specific installed position of each image capturing unit 40 in the corresponding target space SP.

The target object information storage region M4 stores target object data D2. The target object data D2 (object information) is information identifying an object OB (a target object X1) to be subjected to learning processing or air flow control to be described later. A target object X1 is an object that is registered in advance by the user or the administrator as an object of which a movement by an indoor air flow AF is against user's will. In other words, a target object X1 is an object OB to be detected as a specific object X3. The target object data D2 contains information identifying any of a type, a category, a shape, and another characteristic of each target object X1. The target object data D2 is stored in the form of a target object table TB2 illustrated in, for example, FIG. 8. As illustrated in FIG. 8, the target object table TB2 shows information on a target object X1 individually for each row. More specifically, the target object table TB2 illustrated in FIG. 8 identifies "article", "category", "belonging group", "characteristic", and the like for each target object X1. For example, "document", "shichirin (which is a Japanese small charcoal grill)", "ashtray", "plant", "trash bag", "slip", "dustpan", "curtain", and the like are registered as the articles of the target objects X1 in the target object table TB2 illustrated in FIG. 8. Also in the target object table TB2 illustrated in FIG. 8, for example, "paper" is registered as the category of "document" or "slip", "dust, dirt" is registered as the category of "dustpan", "soot, ash" is registered as the category of "shichirin", "ash" is registered as the category of "ashtray", "leaf" is registered as the category of "plant", "synthetic fiber" is registered as the category of "trash bag", and "veil" is registered as the category of "curtain". In the target object table TB2 illustrated in FIG. 8, "paper", "dust, dirt", "soot", "ash", "leaf", "synthetic fiber", "veil", and the like are registered as the categories of the target objects X1. Also in the target object table TB2 illustrated in FIG. 8, a belonging group according to settings by the user or the administrator is registered for each target object X1. Also in the target object table TB2 illustrated in FIG. 8, a characteristic is registered for each target object X1. Examples of the characteristic may include a shape and a size of each target object X1. It should be noted that the target object data D2 is not necessarily generated in the form illustrated in FIG. 8. The generation form of the target object data D2 is changeable as appropriate. For example, the target object data D2 may contain any information in addition to the information illustrated in FIG. 8.

The captured image data storage region M5 stores captured image data D3 output from each image capturing unit 40. The captured image data storage region M5 accumulates captured image data D3 for each image capturing unit 40.

The detection data storage region M6 stores data (detection data D4) identifying a person PS and an object OB detected from captured image data D3 output from each image capturing unit 40. The detection data D4 is generated for each image capturing unit 40 that transmits captured image data D3. More specifically, the detection data D4 is generated for each captured image data D3 received. The detection data D4 is stored in the form of a detection table TB3 illustrated in, for example, FIG. 9. As illustrated in FIG. 9, the detection table TB3 shows information on an object OB or a person PS detected, for each row. More specifically, the detection table TB3 illustrated in FIG. 9 contains information identifying an ID, a name (an article), a category, a located space, a located position, a distance from the blow-out port 22 in the corresponding indoor unit 20, a located date and time, and the like as to an object OB or a person PS detected. For example, the detection table TB3 illustrated in FIG. 9 identifies a certain detected object OB as follows. For example, the ID is "5678921", the name is "document 1", the category is "paper", the located space is "SP2", the located position is "(120,112,0)", the distance from the blow-out port 22 in the corresponding indoor unit 20 is "1650 mm", and the located date and time is "2018/03/05/17:55". The detection table TB3 illustrated in FIG. 9 also identifies a certain detected person PS as follows. For example, the ID is "01139", the name is "person 1", the category is "human", the located space is "SP2", the located position is "(195,101,51)", the distance from the blow-out port 22 in the corresponding indoor unit 20 is "1450 mm", and the located date and time is "2018/03/05/17:55". It should be noted that the detection data D4 is not necessarily generated in the form illustrated in FIG. 9. The generation form of the detection data D4 is changeable as appropriate. For example, the detection data D4 may contain any information in addition to the information illustrated in FIG. 9.

The kinetic object information storage region M7 stores data identifying a kinetic object X2 detected in any one of the target spaces SP (kinetic object data D5) individually. A kinetic object X2 is an object that is supposed to be moved by an indoor air flow AF, among objects OB detected in any one of the target spaces SP. The kinetic object data D5 is stored in the form of a kinetic object table TB4 illustrated in, for example, FIG. 10. As illustrated in FIG. 10, the kinetic object table TB4 shows information on a kinetic object X2 detected individually, for each row. More specifically, the kinetic object table TB4 illustrated in FIG. 10 contains information identifying an ID, a name (an article), a category, a located space, a located position, a distance from the corresponding blow-out port 22, a located date and time, and the like as to each kinetic object X2 detected. The kinetic object table TB4 illustrated in FIG. 10 identifies a certain detected kinetic object X2 as follows. For example, the ID is "5678921", the name is "document 1", the category is "paper", the located space is "SP2", the located position is "(120,112,0)", the distance from the blow-out port 22 in the corresponding indoor unit 20 is "1650 mm", and the located date and time is "2018/03/05/17:55". The kinetic object table TB4 illustrated in FIG. 10 also identifies another detected kinetic object X2 as follows. For example, the ID is "9065893", the name is "paper cup 1", the category is "paper", the located space is "SP2", the located position is "(289,313,65)", the distance from the blow-out port 22 in the corresponding indoor unit 20 is "1750 mm", and the located date and time is "2018/03/05/17:55". It should be noted that the kinetic object data D5 is not necessarily generated in the form illustrated in FIG. 10. The generation form of the kinetic object data D5 is changeable as appropriate. For example, the kinetic object data D5 may contain any information in addition to the information illustrated in FIG. 10.

The specific object information storage region M8 stores data identifying a specific object X3 detected in any one of the target spaces SP (specific object data D6) individually. As will be described later, a specific object X3 corresponds to a target object X1 among kinetic objects X2 detected in any one of the target spaces SP. The specific object data D6 is stored in the form of a specific object table TB5 illustrated in, for example, FIG. 11. The specific object table TB5 illustrated in FIG. 11 contains information identifying an ID, a name (an article), a category, a located space, a located position, a distance from the blow-out port 22 in the corresponding indoor unit 20, a located date and time, and the like as to each specific object X3 detected. The specific object table TB5 illustrated in FIG. 11 identifies a certain specific object X3 detected, as follows. For example, the ID is "5678921", the name is "document 1", the category is "paper", the located space is "SP2", the located position is "(120,112,0)", the distance from the blow-out port 22 in the corresponding indoor unit 20 is "1650 mm", and the located date and time is "2018/03/05/17:55". It should be noted that the specific object data D6 is not necessarily generated in the form illustrated in FIG. 11. The generation form of the specific object data D6 is changeable as appropriate. For example, the specific object data D6 may contain any information in addition to the information illustrated in FIG. 11.

The input information storage region M9 stores information input to the controller 60. For example, the input information storage region M9 stores a command input through each terminal 90.

The characteristic data storage region M10 stores characteristic data D7 identifying a general characteristic of a person PS or an object OB or individually identifying characteristics unique to a person PS and an object OB detected in any one of the target spaces SP. The characteristic data D7 is prepared for each person PS or object OB. In the first embodiment, the "characteristic" refers to information for uniquely identifying a person PS or an object OB. A person PS has various "characteristics" such as a shape, a dimension, a color, and an operation (e.g., an operating speed, an operating range, an operating angle) of a portion (e.g., a head, a whorl of hair, a face, a shoulder, an arm, a leg)

of the person PS. An object OB has various "characteristics" such as a shape, a dimension, a color, and an operation of the object OB.

The learning data storage region M11 stores learning data D8 individually identifying a limit air flow direction and a limit air flow volume as to a specific object X3 detected in any one of the target spaces SP. In the first embodiment, the limit air flow direction and the limit air flow volume refer to a direction of an air flow by which a specific object X3 is inhibited from being moved, a volume of an air flow by which a specific object X3 is inhibited from being moved, or a combination of the direction with the volume. The learning data D8 is stored in the form of an air flow direction and air flow volume table TB6 illustrated in, for example, FIG. 12. The air flow direction and air flow volume table TB6 illustrated in FIG. 12 contains information identifying an ID, a located space, a located position, a distance from the blow-out port 22 in the corresponding indoor unit 20, a located date and time, a limit air flow direction and a limit air flow volume, and the like as to a specific object X3 detected. The air flow direction and air flow volume table TB6 illustrated in FIG. 12 identifies a certain specific object X3 detected, as follows. For example, the ID is "5678921", the located space is "SP2", the located position is "(120, 112,0)", the distance from the blow-out port 22 in the corresponding indoor unit 20 is "1650 mm", the located date and time is "2018/03/05/17:55", the limit air flow directions and the air flow volumes are "air flow direction 1: minimum air flow volume", "air flow direction 2: middle air flow volume", and "air flow direction 4: large air flow volume". In the first embodiment, the air flow direction and air flow volume table TB6 defines a plurality of limit air flow directions, limit air flow volumes, and combinations thereof for each specific object X3. In other words, the learning data D8 contains a plurality of pieces of information identifying volumes and directions of an air flow by which each specific object X3 is inhibited from being moved. It should be noted that the learning data D8 is not necessarily generated in the form illustrated in FIG. 12. The generation form of the learning data D8 is changeable as appropriate. For example, the learning data D8 may contain any information in addition to the information contained in the air flow direction and air flow volume table TB6 illustrated in FIG. 12.

(3-2) Acquisition Section 62

The acquisition section 62 acquires captured image data D3 output from each image capturing unit 40, and stores the captured image data D3 in the captured image data storage region M5 as appropriate.

(3-3) Detection Section 63

The detection section 63 is a functional section that detects a person PS and an object OB, based on captured image data D3 in the captured image data storage region M5. The detection section 63 includes a first detection section 631, a second detection section 632, and a determination section 633.

The first detection section 631 is a functional section that detects a person PS and an object OB contained in captured image data D3 in the captured image data storage region M5, and generates detection data D4. The first detection section 631 executes processing of individually detecting a person PS and an object OB contained in the captured image data D3 in the captured image data storage region M5 (detection processing). The first detection section 631 executes the detection processing every time. However, the first detection section 631 may execute the detection processing at any timing that is changeable as appropriate. The detection processing is executed for each captured image data D3. In other words, the detection processing is executed for each image capturing unit 40 that transmits captured image data D3.

The first detection section 631 is configured to perform machine learning. Specifically, the first detection section 631 performs machine learning using methods of, for example, "neural network" and "deep learning". This learning may be either "supervised learning" or "unsupervised learning".

The first detection section 631 executes the detection processing using a predetermined method (including publicly-known techniques). For example, the first detection section 631 detects and identifies a person PS or an object OB, based on characteristic data D7 in which the characteristic of the person PS or the object OB is defined in advance. For example, the first detection section 631 recognizes a characteristic of a person PS or an object OB in captured image data D3, thereby detecting the person PS or the object OB. In addition, the first detection section 631 compares the recognized characteristic with a characteristic defined in characteristic data D7, thereby uniquely identifying the person PS or the object OB.

Figure 13:
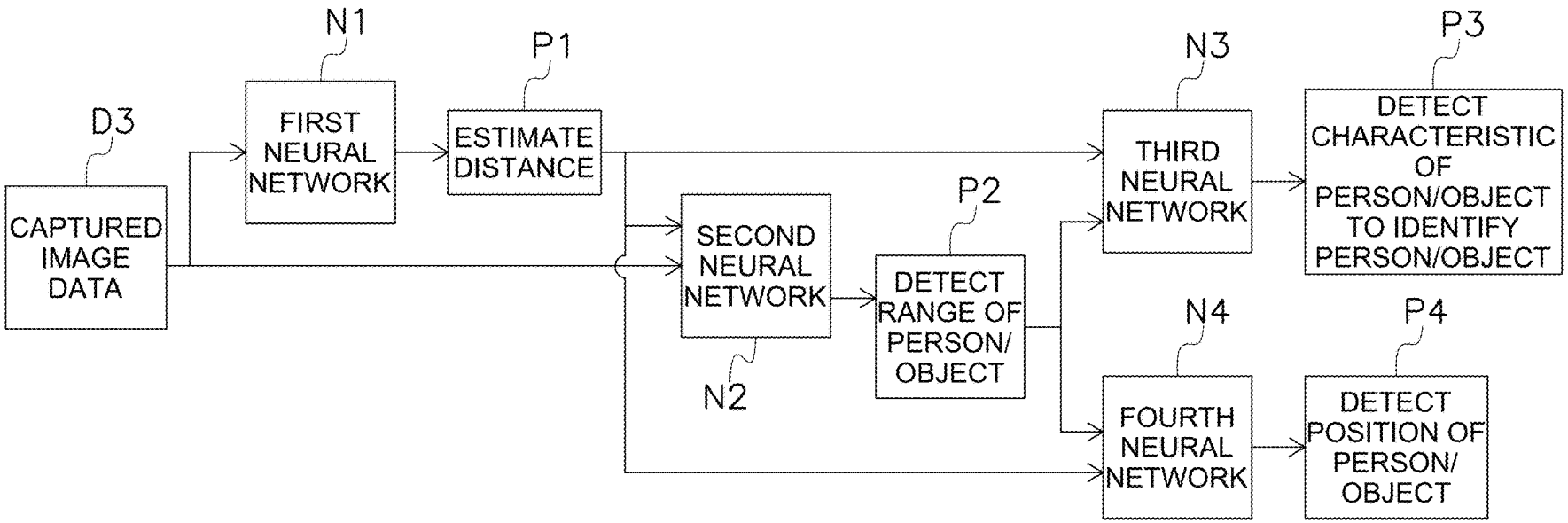
FIG. 13 is a schematic diagram of exemplary detection processing executed by a first detection section.

FIG. 13 illustrates exemplary detection processing to be executed by the first detection section 631. FIG. 13 illustrates an example in which the first detection section 631 detects a person PS or an object OB in any one of the target spaces SP, using a plurality of neural networks (N1, N2, N3, N4).

As illustrated in FIG. 13, first, captured image data D3 is input to the first neural network N1. The first neural network N1 executes processing P1 of detecting (estimating) distances among the elements contained in the captured image data D3.

Next, the captured image data D3 and a result of the processing P1 are input to the second neural network N2. The second neural network N2 executes processing P2 of detecting (estimating) a range of a person PS or an object OB contained in the captured image data D3, based on the result of the processing P1. When the range of the person PS or the object OB is detectable, a movement of the person PS or the object OB is detectable. In processing P3 to be described later, therefore, a characteristic of the person PS or the object OB is acquirable.

Next, the result of the processing P1 and a result of the processing P2 are input to the third neural network N3. The third neural network N3 executes the processing P3 of detecting and identifying the characteristics of the person PS and the object OB in the captured image data D3, based on the result of the processing P1 and the result of the processing P2. In the processing P3, the person PS or the object OB is uniquely identified based on the detected characteristic of the person PS or the object OB and characteristic data D7 stored in the characteristic data storage region M10. For example, the processing P3 includes calculating a similarity between the detected characteristic of the person PS or the object OB and each characteristic data D7 in the characteristic data storage region M10, and detecting a person PS or an object OB in characteristic data D7 of which the calculated similarity is equal to or more than a predetermined threshold value as a person PS or an object OB whose characteristic is the same as the detected characteristic, thereby uniquely identifying the person PS or the object OB. When the characteristic data storage region M10 stores no characteristic data D7 of which a similarity to the detected characteristic of the person PS or the object OB is equal to or more than the predetermined threshold value, characteristic data D7 is newly generated for the person PS or the object OB having the characteristic, and is stored as a person PS or an object OB newly detected. The characteristic data D7 generated as a result of the processing P3 is, for example, 100-dimensional vector data.

Next, the result of the processing P1 and the result of the processing P2 are input to the fourth neural network N4. The fourth neural network N4 executes processing P4 of detecting the positions (coordinates) of the person PS and the object OB, contained in the captured image data D3, in the corresponding target space SP, based on the result of the processing P1 and the result of the processing P2.

When the detection processing is executed as described above, the first detection section 631 estimates distances among the respective elements from the captured image data D3, and extracts the person PS or the object OB, based on the estimated distances, in the detection processing. The first detection section 631 also detects the position of the object OB in the corresponding target space SP. More specifically, the first detection section 631 detects the position of the object OB relative to the indoor unit 20 in the target space SP. The first detection section 631 also detects the distance between the object OB and the blow-out port 22 in the indoor unit 20.

The first detection section 631 appropriately learns about the characteristics of the person PS and the object OB, using various kinds of information (e.g., information acquirable from the captured image data D3, information acquirable via the wide area network NW1). For example, the first detection section 631 individually leans about the details of the characteristics of the person PS and the object OB in the captured image data D3, and appropriately updates the corresponding characteristic data D7. This configuration inhibits variations in result of detection owing to changes in characteristic of a person PS or an object OB (e.g., changes in clothes and hairstyles, degradation in color of an object).

The first detection section 631 generates detection data D4 (FIG. 9), based on the result of the detection processing. The first detection section 631 incorporates, into the detection data D4, information identifying, for example, an ID, a name (an article), a category, a located space, a detected position (a located position), and a detected date and time (a located date and time) as to the detected person PS or object OB. The first detection section 631 generates detection data D4 for each image capturing unit 40 that transmits captured image data D3.

Each of the second detection section 632 and the determination section 633 is a functional section that detects a specific object X3 in any one of the target spaces SP, based on captured image data D3. Specifically, the detection section 63 including the second detection section 632 and the determination section 633 executes processing of detecting a specific object X3, based on an image captured by each image capturing unit 40 (specific object detection processing).

The second detection section 632 is a functional section that detects a kinetic object X2 in any one of the target spaces SP. The second detection section 632 executes processing of detecting a kinetic object X2 (kinetic object detection processing) in the specific object detection processing. In the kinetic object detection processing, the second detection section 632 detects a kinetic object X2, based on detection data D4 stored in the detection data storage region M6. In other words, the second detection section 632 detects a kinetic object X2, based on an image captured by each image capturing unit 40. The second detection section 632 executes the kinetic object detection processing at predetermined timing. For example, the second detection section 632 executes the kinetic object detection processing every 10 seconds. However, the kinetic object detection processing may be executed at any timing that is changeable as appropriate.

In the kinetic object detection processing, the second detection section 632 makes a determination as to presence or absence of a kinetic object X2, by comparing positions of objects OB contained in detection data D4 with one another in a time-series manner to determine whether each object OB is moved in excess of a predetermined threshold value (an amount of movement). This threshold value is appropriately set in accordance with a type, design specifications, an installation environment, and the like of an object OB, and is defined in a control program.

The second detection section 632 sets the kinetic object flag F1 when detecting a kinetic object X2 as a result of the kinetic object detection processing. In addition, the second detection section 632 generates or updates kinetic object data D5 (FIG. 10). The second detection section 632 incorporates, into the kinetic object data D5, information identifying, for example, an ID, a name (an article), a category, a located space, a located position (a detected position), a distance from the corresponding blow-out port 22, and a located date and time (a detected date and time) as to the kinetic object X2 detected. The second detection section 632 stores the generated or updated kinetic object data D5 in the kinetic object information storage region M7.

The determination section 633 is a functional section that detects a specific object X3 in any one of the target spaces SP, based on a result of the kinetic object detection processing. The determination section 633 executes processing of determining whether the kinetic object X2 detected by the second detection section 632 is a target object X1 (specific object determination processing) in the specific object detection processing. The determination section 633 executes the specific object determination processing to determine whether the detected kinetic object X2 is a specific object X3. In the first embodiment, a specific object X3 corresponds to a kinetic object X2 that is moved by an indoor air flow AF and a target object X1 registered in advance, among objects OB in any one of the target spaces SP.

The determination section 633 executes the specific object determination processing, based on the target object data D2 stored in the target object information storage region M4 and the kinetic object data D5 stored in the kinetic object information storage region M7. In other words, the determination section 633 executes the specific object determination processing, based on an image captured by each image capturing unit 40 and information on a specific object registered in advance. When the kinetic object flag F1 is set, the determination section 633 executes the specific object determination processing at predetermined timing. For example, the determination section 633 executes the specific object determination processing every 10 seconds. However, the specific object determination processing may be executed at any timing that is changeable as appropriate.

In the specific object determination processing, the determination section 633 detects a specific object X3 by determining whether each kinetic object X2 contained in the kinetic object data D5 corresponds to any of the target objects X1 registered in the target object data D2 stored in the target object information storage region M4.

The determination section 633 clears the kinetic object flag F1 when the specific object determination processing is completed as to each kinetic object X2 detected in the kinetic object detection processing. When a specific object X3 is detected as a result of the specific object determination processing, the determination section 633 generates specific object data D6 containing information on the specific object X3, and stores the specific object data D6 in the specific object information storage region M8. When the specific object X3 is detected as the result of the specific object determination processing, the determination section 633 sets the bits corresponding to the second control mode. When no specific object X3 is detected as the result of the specific object determination processing, the determination section 633 sets the bits corresponding to the first control mode in the control mode flag F2.

(3-4) Mode Control Section 64

The mode control section 64 is a functional section that switches a control mode. The mode control section 64 switches a control mode, based on a state of the control mode flag F2. The mode control section 64 switches the control mode to the first control mode when the bits corresponding to the first control mode are set in the control mode flag F2. The mode control section 64 switches the control mode to the second control mode when the bits corresponding to the second control mode are set in the control mode flag F2.

(3-5) Device Control Section 65 (Control Section)

The device control section 65 controls, based on the control program, the operations of the respective devices (e.g., the indoor fans 21, the flaps 23) in the air conditioning system 100 in accordance with a situation. The device control section 65 also refers to the control mode flag F2, thereby determining a control mode in which the controller 60 is placed, and controls the operations of the respective devices, based on the determined control mode.

The device control section 65 includes a learning section 651 configured to perform learning. The learning section 651 executes learning processing in the second control mode. The learning processing involves, in a case where a specific object X3 is present in any one of the target spaces SP, controlling one of or both of a volume and a direction of an indoor air flow AF so as to inhibit the specific object X3 from being moved by the indoor air flow AF, and learning about one of or both of a limit air flow direction and a limit air flow volume regarding the specific object X3. The learning processing involves performing machine learning using methods of, for example, "neural network" and "deep learning". The learning processing may be either "supervised learning" or "unsupervised learning". Alternatively, the learning processing may be learning using none of "neural network" and "deep learning". The following description concerns exemplary learning processing.

In the learning processing, the learning section 651 refers to specific object data D6 stored in the specific object information storage region M8 to determine a located space and a located position of the specific object X3 detected. The learning section 651 performs learned air flow control for controlling one of or both of the number of rotations of the indoor fan 21 and the flap 23 in the corresponding indoor unit 20. In the learned air flow control, for example, the learning section 651 reduces the number of rotations of the indoor fan 21 so as to reduce the volume of the air flow sent to the specific object X3 to be subjected to the learned air flow control. In the learned air flow control, for example, the learning section 651 controls the flap 23 so as to reduce the volume of the indoor air flow AF sent to the specific object X3 by changing the direction of the indoor air flow AF, in place of this control or in addition to this control.

In the learned air flow control, the learning section 651 controls the number of rotations of the indoor fan 21 or the flap 23 in accordance with a position of the specific object X3 relative to the indoor unit 20. In the learned air flow control, the learning section 651 controls the number of rotations of the indoor fan 21 or the flap 23 in accordance with particularly a distance between the indoor unit 20 (the blow-out port) and the specific object X3. For example, the learning section 651 increases or decreases the degree of change in the number of rotations of the indoor fan 21 or the flap 23, in accordance with the position of the specific object X3 relative to the indoor unit 20 or the distance between the indoor unit 20 (the blow-out port) and the specific object X3. In other words, the learning section 651 executes the learning processing in consideration of the position of the specific object X3 relative to the indoor unit 20 or the distance between the indoor unit 20 (the blow-out port) and the specific object X3.

In the learned air flow control, the learning section 651 controls the number of rotations of the indoor fan 21 or the flap 23 in accordance with a located position of a person PS in the target space SP. For example, the learning section 651 increases or decreases the degree of change in the number of rotations of the indoor fan 21 or the flap 23, in accordance with the located position of the person PS in the target space SP. In other words, the learning section 651 executes the learning processing in consideration of the located position of the person PS in the target space SP.

The learning section 651 waits for a lapse of a predetermined time after completion of the learned air flow control, and then refers to specific object data D6 stored in the kinetic object information storage region M7. The predetermined time is, for example, equal to or more than a cycle in which the detection section 63 updates the specific object data D6. When the latest specific object data D6 updated after completion of the learned air flow control still contains the specific object X3 to be subjected to the learned air flow control, the learning section 651 performs the learned air flow control again. The learning section 651 repeatedly performs the learned air flow control until the latest specific object data D6 does not contain the specific object X3 to be subjected to the learned air flow control. In other words, the learning section 651 repeatedly performs the learned air flow control until the specific object X3 to be subjected to the learned air flow control is not detected (moved) in the target space SP. That is, the learning section 651 repeatedly performs the learned air flow control until the limit air flow direction or the limit air flow volume regarding the specific object X3 to be subjected to the learned air flow control is identified.

In the learning processing, the device control section 65 learns about one of or both of the limit air flow direction and the limit air flow volume regarding the specific object X3 contained in the specific object data D6. The device control section 65 registers or updates, in learning data D8, information on a limit air flow direction and a limit air flow volume regarding the object OB to be subjected to the learning processing (i.e., the object OB detected as the specific object X3). After completion of the learning processing, the device control section 65 clears the bits corresponding to the second control mode in the control mode flag F2, and then sets the bits corresponding to the first control mode.

In the first control mode, the device control section 65 controls, in real time, an operating capacity of the compressor, the outdoor fan, opening degrees of expansion valve, the number of rotations of the indoor fan 21, and the operation of the flap 23, in accordance with, for example, an input command and values detected by the respective sensors. In the first control mode, the device control section 65 performs the air flow control (first processing), based on a result of the learning processing. In the air flow control, the device control section 65 refers to detection data D4 stored in the detection data storage region M6 and learning data D8 stored in the learning data storage region M11 to determine whether the object OB to be subjected to the learning processing is present in the target space SP. When the object OB to be subjected to the learning processing is present in the target space SP, the device control section 65 controls one of or both of the indoor fan 21 and the flap 23 such that the indoor air flow AF is sent to the object OB in accordance with the limit air flow direction and the limit air flow volume defined in the learning data D8.

In other words, in the first control mode, the device control section 65 performs the air flow control of controlling the volume of the indoor air flow AF to be sent to the specific object X3 such that the specific object X3 is inhibited from being moved. In the air flow control, the device control section 65 controls the number of rotations of the indoor fan 21 or the flap 23, based on the position of the specific object X3 relative to the indoor unit 20 (the blow-out port 22). In particular, in the air flow control, the device control section 65 controls the number of rotations of the indoor fan 21 or the flap 23 in accordance with the distance between the indoor unit 20 (the blow-out port 22) and the specific object X3. In the air flow control, the device control section 65 controls the number of rotations of the indoor fan 21 or the flap 23 in accordance with the located position of the person PS in the target space SP.

(3-6) Drive Signal Output Section 66

The drive signal output section 66 outputs drive signals (drive voltages) corresponding to the devices (e.g., the indoor fan 21, the flap 23) in accordance with the details of control by the device control section 65. The drive signal output section 66 includes a plurality of inverters (not illustrated), and to the specific device (e.g., the indoor fan 21), drive signals are output from the corresponding inverter.

(3-7) Acceptance Section 67

The acceptance section 67 acquires information input to the controller 60, and stores the information in the input information storage region M9. The information input to the controller 60 is, for example, a command regarding the operation of the air conditioning system 100. Alternatively, the information input to the controller 60 is, for example, a command for instructing, for example, addition or deletion of a target object X1 to or from target object data D2 (an update command). The update command indicates the target object X1 to be updated and the details of the update.

(3-8) Update Section 68

The update section 68 updates target object data D2, based on an update command stored in the input information storage region M9. The update section 68 stores the updated target object data D2 in the target object information storage region M4.

(4) Processing by Controller 60

Figure 14:
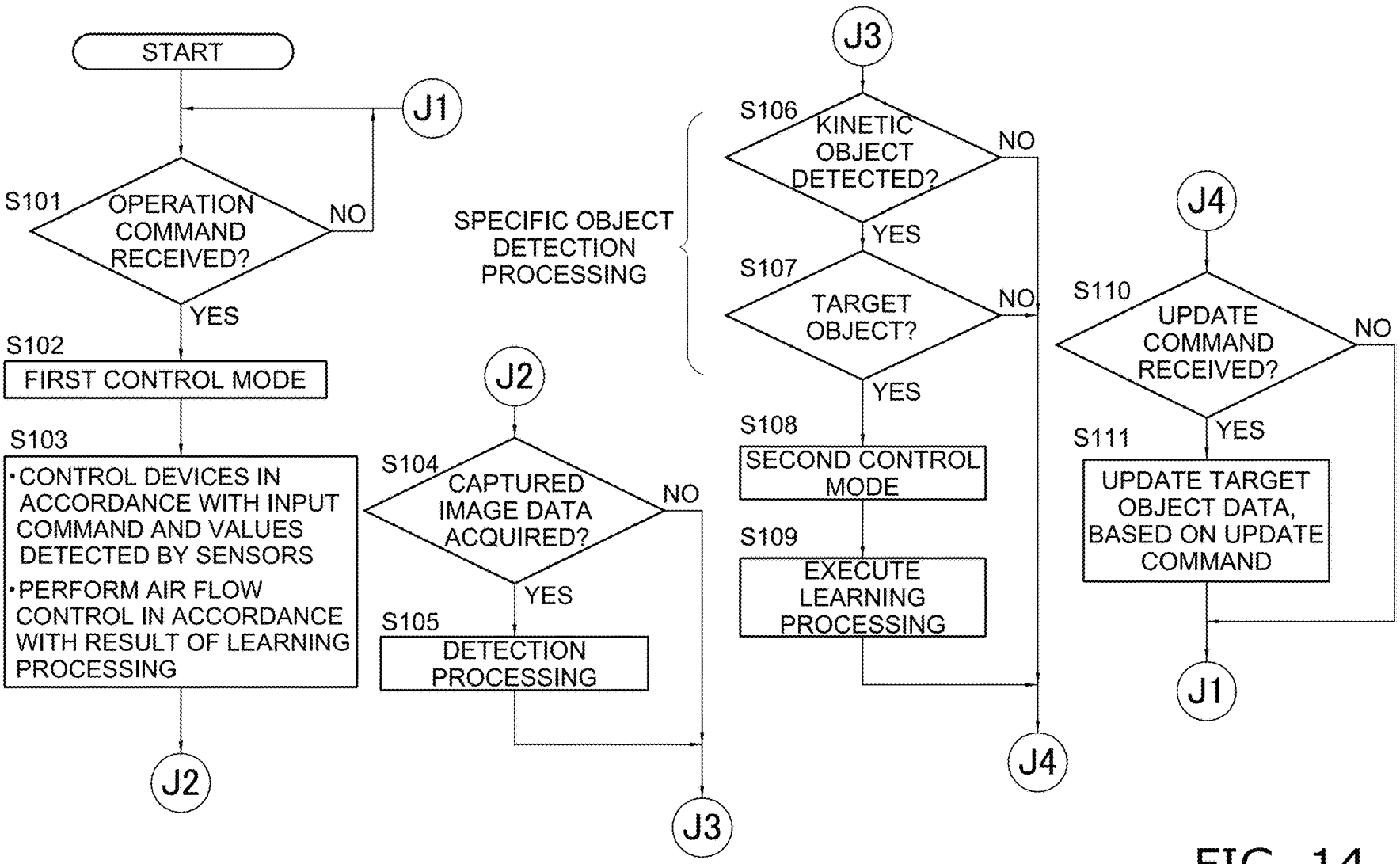
FIG. 14 is a flowchart of exemplary processing to be executed by a controller.

With reference to FIG. 14, next, a description will be given of exemplary processing to be executed by the controller 60. FIG. 14 is a flowchart of the exemplary processing to be executed by the controller 60.

The controller 60 sequentially carries out steps S101 to S111 illustrated in FIG. 14. The sequence of the processing illustrated in FIG. 14 is changeable as appropriate. For example, the order of the steps may be changed, some of the steps may be carried out simultaneously, or a step not illustrated in FIG. 14 may be added as long as the processing is executed correctly.

In step S101, when the controller 60 receives no operation command instructing a start of an operation (NO in step S101), the processing remains in step S101. On the other hand, when the controller 60 receives an operation command instructing a start of an operation (YES in step S101), the processing proceeds to step S102.

In step S102, the controller 60 is placed in the first control mode or is maintained at the first control mode. The processing then proceeds to step S103.

In step S103, the controller 60 (the device control section 65) controls the states of the respective devices in real time in accordance with, for example, the received command, the set temperatures, and the values detected by the respective sensors, thereby causing the air conditioner 10 to perform the operation. The controller 60 performs the air flow control to inhibit an object OB detected as a specific object X3 from being moved, and controls a volume of an indoor air flow AF to be sent toward the object OB. Specifically, when an object OB detected as a specific object X3 is present in any one of the target spaces SP, the controller 60 controls one of or both of the indoor fan 21 and the flap 23 such that an air flow is sent toward the object OB, based on a limit air flow direction and a limit air flow volume in learning data D8. The processing then proceeds to step S104.

In step S104, when the controller 60 acquires no captured image data D3, that is, when no captured image data D3 is newly stored in the storage section 61 (NO in step S104), the processing proceeds to step S106. When the controller 60 acquires captured image data D3 (YES in step S104), the processing proceeds to step S105.

In step S105, the controller 60 (the first detection section 631) executes the detection processing to detect a person PS and an object OB contained in the captured image data D3 acquired. The controller 60 generates detection data D4 regarding the person PS or the object OB detected in the detection processing. The controller 60 learns about a characteristic of the person PS or the object OB detected in the detection processing, and generates or updates characteristic data D7. The processing then proceeds to step S106.

In steps S106 and S107, the controller 60 (the detection section 63) executes the specific object detection processing to detect a specific object X3 in the target space SP.

In step S106, the controller 60 (the second detection section 632) executes the kinetic object detection processing. When the controller 60 detects no kinetic object X2 in the target space SP as a result of the kinetic object detection processing (NO in step S106), the processing proceeds to step S110. When the controller 60 detects a kinetic object X2 in the target space SP as a result of the kinetic object detection processing (YES in step S106), the processing proceeds to step S107.

In step S107, the controller 60 (the determination section 633) executes the specific object determination processing to determine whether the detected kinetic object X2 is a target object X1. When the controller 60 determines that the kinetic object X2 is different from the target object X1 as a result of the specific object determination processing (NO in step S107), the processing proceeds to step S110. When the controller 60 determines that the kinetic object X2 is the target object X1 as a result of the specific object determination processing, that is, when the controller 60 detects the specific object X3 (YES in step S107), the processing proceeds to step S108.

In step S108, the controller 60 is placed in the second control mode. The processing then proceeds to step S109.

In step S109, the controller 60 (the learning section 651) executes the learning processing to learn about one of or both of a limit air flow direction and a limit air flow volume regarding the specific object X3, and generates or updates learning data D8. The processing then proceeds to step S110.

In step S110, when the controller 60 receives no update command (NO in step S110), the processing returns to step S101. On the other hand, when the controller 60 receives an update command (YES in step S110), the processing proceeds to step S111.

In step S111, the controller 60 (the update section 68) updates the target object data D2, based on the received update command. The processing then returns to step S101.

(5) Features (5-1)

According to the first embodiment, the controller 60 includes: the acquisition section 62 configured to acquire captured image data D3 (a captured image) in any one of the target spaces SP; the detection section 63 configured to detect a specific object X3 movable by an air flow which the corresponding indoor unit 20 sends, based on captured image data D3; and the device control section 65 configured to perform the air flow control. The device control section 65 performs the air flow control to control at least one of a direction or a volume of the air flow which the indoor unit 20 sends (the indoor air flow AF), based on a result of detection by the detection section 63. According to this configuration, the controller 60 detects, from the captured image data D3, the specific object X3 movable by the air flow which the indoor unit 20 sends, in the target space SP, and makes it possible to control at least one of the direction or the volume of the air flow which the indoor unit 20 sends, so as to inhibit the specific object X3 from being moved against user's will.

(5-2)

In the first embodiment, the device control section 65 performs the air flow control to control at least one of the direction or the volume of the air flow which the indoor unit 20 sends, such that the specific object X3 is not moved by the air flow which the indoor unit 20 sends. According this configuration, the controller 60 controls at least one of the direction or the volume of the air flow which the indoor unit 20 sends, so as to inhibit the specific object X3 from being moved against user's will.

(5-3)

In the first embodiment, the device control section 65 performs the air flow control to reduce the volume of the air flow which the indoor unit 20 sends to the specific object X3 (the indoor air flow AF). According to this configuration, the controller 60 makes it possible to simply control the indoor unit 20 such that the specific object X3 is not moved by the air flow which the indoor unit 20 sends.

(5-4)

In the first embodiment, the detection section 63 detects a position of the specific object X3 relative to the indoor unit 20. According to this configuration, the controller 60 makes it possible to accurately perform the air flow control in consideration of the position of the specific object X3 relative to the indoor unit 20.

(5-5)

In the first embodiment, the detection section 63 detects a distance between the indoor unit 20 and the specific object X3. According to this configuration, the controller 60 makes it possible to accurately perform the air flow control in consideration of the distance between the indoor unit 20 and the specific object X3.

(5-6)

In the first embodiment, the controller 60 includes the storage section 61 configured to store target object data D2 which is information on the specific object X3. The detection section 63 detects the specific object X3, based on the target object data D2 stored in the storage section 61. According to this configuration, the controller 60 makes it possible to reliably perform the air flow control on the object by optionally registering the information on the specific object X3 to be subjected to the first processing in advance.

(5-7)

In the first embodiment, a target object X1 to be detected as the specific object X3 includes at least one of paper, fiber, a veil, ash, soot, dust, or dirt. According to this configuration, the controller 60 makes it possible to perform the air flow control on an object OB as to which the user does not desire that the object OB is moved by the air flow which the indoor unit 20 sends.

(5-8)

In the first embodiment, the controller 60 includes the learning section 651. The learning section 651 is configured to learn about at least one of the volume or the volume of the air flow by which the specific object X3 is inhibited from being moved, based on a result of the learned air flow control (the learning processing) performed. According to this configuration, the controller 60 performs the air flow control with improved accuracy on the specific object X3 in the target space SP, and therefore reliably inhibits the specific object X3 from being moved.

(5-9)

In the first embodiment, the controller 60 includes the update section 68 configured to update the target object data D2. According to this configuration, the controller 60 makes it possible to appropriately update the information on the specific object X3 to be subjected to the first processing.

(5-10)

In the first embodiment, the detection section 63 detects a person PS in the target space SP, based on the captured image data D3 acquired by the acquisition section 62. According to this configuration, the controller 60 makes it possible to achieve fine control while taking a relationship between the specific object X3 and the person PS into consideration.

(5-11)

In the first embodiment, the air conditioner 10 includes the controller 60. According to this configuration, in the air conditioner 10, the controller 60 makes it possible to control at least one of the direction or the volume of the air flow which the indoor unit 20 sends, so as to inhibit the specific object X3 from being moved against user's will.

(5-12)

In the first embodiment, the air conditioning system 100 includes the indoor unit 20, the image capturing unit 40 installed in the target space SP, and the controller 60. The air conditioning system 100 thus controls at least one of the direction or the volume of the air flow so as to inhibit the specific object X3 from being moved against user's will.

(6) Modifications

The first embodiment may be appropriately modified as described in the following modifications. It should be noted that these modifications are applicable in conjunction with other modifications insofar as there are no contradictions.

(6-1) Modification 1

Figure 15:
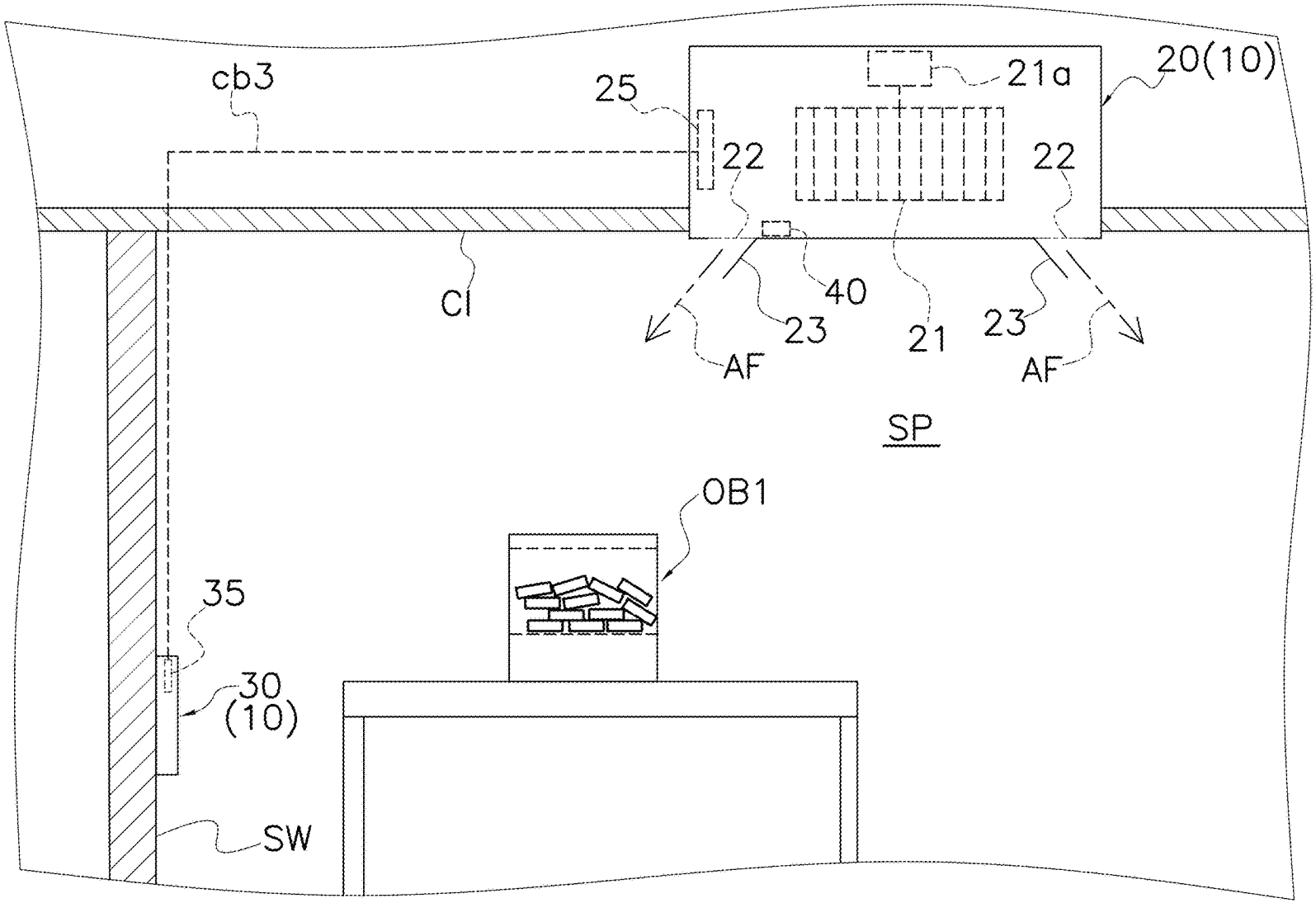
FIG. 15 is a schematic diagram of exemplary installation of the devices and objects in the target space according to Modification 1.

The first embodiment describes the case where the learning processing and the air flow control are performed with "paper" detected as a specific object X3. However, an object OB to be detected as a specific object X3 is not necessarily limited to "paper". As illustrated in FIG. 15, for example, in a case where a shichirin (OB1) is present in a target space SP, the shichirin or soot or ash in the shichirin is detected as a specific object X3, and this specific object X3 may be subjected to the learning processing or the air flow control. Particularly in a restaurant or the like, soot or ash in a shichirin may be blown off or stirred up by an air flow which a fan sends, against user's will. However, the idea of the present disclosure suppresses occurrence of such a situation.

(6-2) Modification 2

The first embodiment describes that a target object X1 registered in target object data D2 is "paper (a document or a slip in the first embodiment)", "soot (a shichirin in the first embodiment)", "ash (a shichirin or an ashtray in the first embodiment)", "leaf (a plant in the first embodiment)", "synthetic fiber (a trash bag in the first embodiment)", "dust, dirt (a dustpan in the first embodiment)", or "veil (a curtain in the first embodiment)". However, a target object X1 to be registered in target object data D2 is not necessarily limited thereto, and is changeable as appropriate. In other words, a target object X1 to be registered in target object data D2 may be any object in addition to the objects described in the first embodiment. Examples of the target object X1 to be registered in the target object data D2 may include cloth, a blind curtain, a book or any book-form medium, a desktop calendar, paper money, any fiber, a cooking utensil, and a string to be pulled for switching on or off a lighting fixture. The target object X1 to be registered in the target object data D2 may also be smoke issued from a cooking utensil, an ashtray, or the like.

(6-3) Modification 3

In the first embodiment, the specific object detection processing is executed in accordance with the flowchart of FIG. 14. As a matter of course, the controller 60 may execute the specific object detection processing in accordance with a flow different from the flowchart of FIG. 14 in order to identify a specific object X3. In the case where the controller 60 executes processing different from that illustrated in FIG. 14, processing to be executed by each functional section in the controller 60 is added or changed as appropriate.

Figure 16:
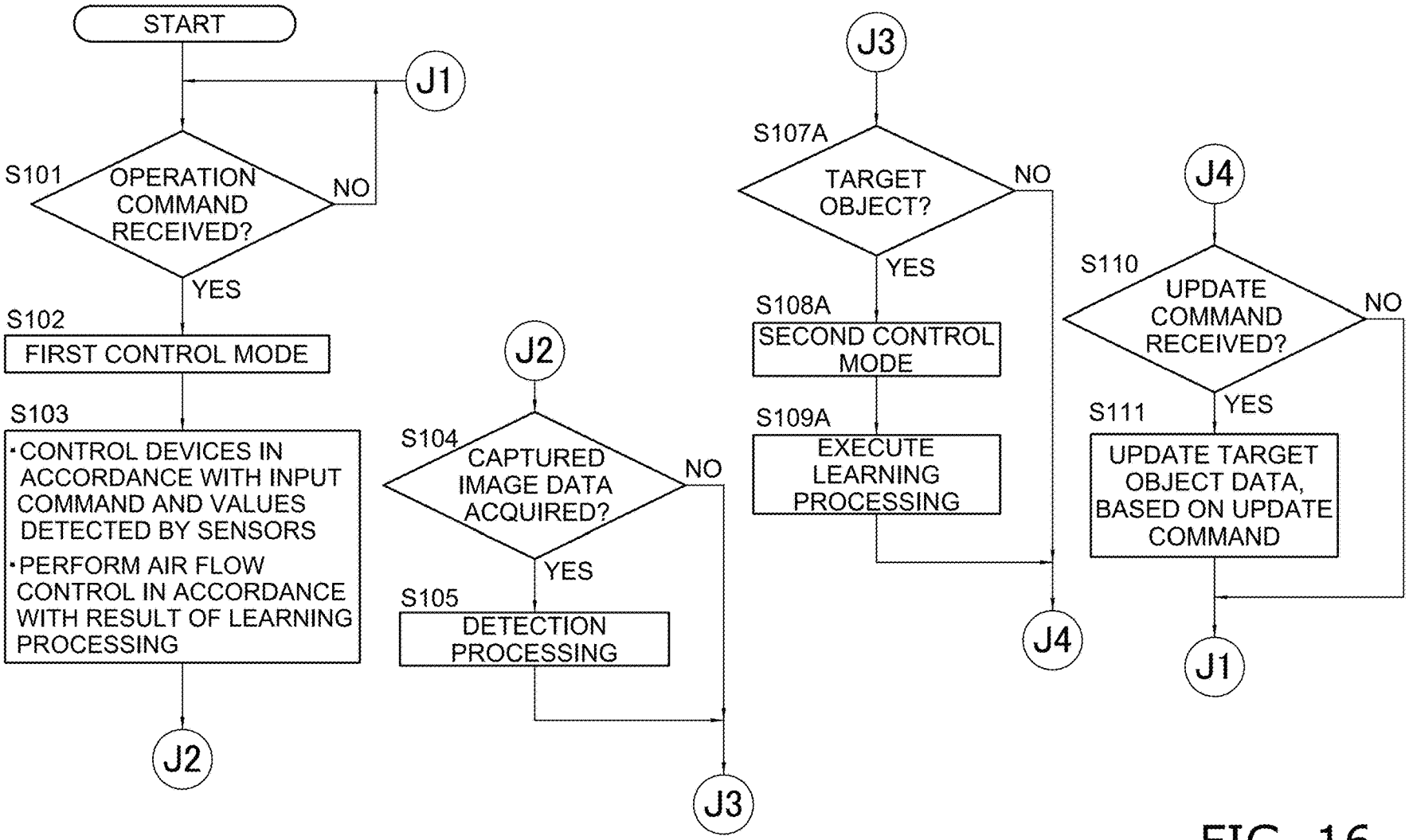
FIG. 16 is a flowchart of exemplary processing to be executed by the controller according to Modification 3.

For example, the controller 60 may execute the specific object determination processing in such a manner that the determination section 633 determines whether information on an object OB detected by the first detection section 631 and stored in detection data D4 corresponds to a target object X1. In other words, unlike the first embodiment, the specific object determination processing may be executed without performing detection of a kinetic object X2 by the second detection section. Specifically, the processing may be executed in accordance with a flowchart of FIG. 16 from which step S106 is omitted. In FIG. 16, steps S101 to S105, step S110, and step S111 are similar to those described in the first embodiment. In FIG. 16, steps S107A, S108A, and S109A are carried out in place of steps S107 to S109.

As illustrated in FIG. 16, step S107A involves determining whether a target object X1 is present in any one of the target spaces SP. For example, in step S107A, the determination section 633 determines whether an object OB detected by the first detection section 631 is a target object X1. In this step, the object OB determined as a target object X1 is determined as a specific object X3. In step S107A, when the determination section 633 determines that the object OB detected by the first detection section 631 is the target object X1 (YES in step S107A), the processing proceeds to step S108A. In step S107A, when the determination section 633 determines that the object OB detected by the first detection section is not the target object X1 (NO in step S107A), the processing proceeds to step S110.

In step S108A, the controller 60 is placed in a second control mode. The second control mode in this case is a control mode in which the controller 60 is placed irrespective of whether or not the target object X1 detected in the target space SP is a kinetic object X2. The processing then proceeds to step S109A.

In step S109A, the controller 60 executes learning processing. The learning processing in this case is processing of, when the target object X1 is detected in the target space SP, sending an air flow to the target object X1 and learning about one of or both of a limit air flow direction and a limit air flow volume regarding the target object X1. In other words, the learning processing in this case involves positively sending an air flow to the target object X1 that is not moved by the fir flow which the indoor unit 20 sends, and learning about one of or both of the limit air flow direction and the limit air flow volume. In this learning processing, for example, the learning section 651 learns about the limit air flow direction or the limit air flow volume regarding the target object X1 in such a manner that one of or both of the direction and the volume of the indoor air flow AF is or are controlled such that the air flow AF is sent by a predetermined volume to the target object X1 that is not moved by the indoor air flow AF in the target space SP. In this learning processing, for example, the learning section 651 also learns about the limit air flow direction or the limit air flow volume regarding the target object X1 that is moved by the indoor air flow AF, as in a manner similar to that described in the first embodiment. In this learning processing, for example, the learning section 651 gradually increases the volume of the air flow to be sent toward the target object X1 (the indoor air flow AF) until the target object X1 is moved by the indoor air flow AF. The learning section 651 stores a result of the learning processing in learning data D8. The processing then proceeds to step S110.

Also in the case where the learning processing is executed as described above, the device control section 65 performs air flow control in accordance with the limit air flow direction and the limit air flow volume regarding the target object X1, based on the result of the learning processing. In Modification 3, the target object X1 detected in the target space SP is determined as the specific object X3 irrespective of whether or not the target object X1 is moved by the air flow which the indoor unit 20 sends. In Modification 3, the specific object X3 is an object OB that is detected in the target space SP and is registered in advance as an object supposed to be moved by the indoor air flow AF.

In the case where the processing is carried out in accordance with this flowchart, the second detection section 632 may be omitted as appropriate.

(6-4) Modification 4

Alternatively, specific object detection processing may be executed in accordance with a flowchart different from those described in the first embodiment and Modification 3 in order to identify a specific object X3. For example, the specific object determination processing may be executed in such a manner that the determination section 633 determines, as a specific object X3, an object OB detected by the second detection section 632 and stored in kinetic object data D5. Unlike the first embodiment, the specific object determination processing may be executed without a determination by the determination section 633 as to whether target object data D2 and the kinetic object data D5 match.

Figure 17:
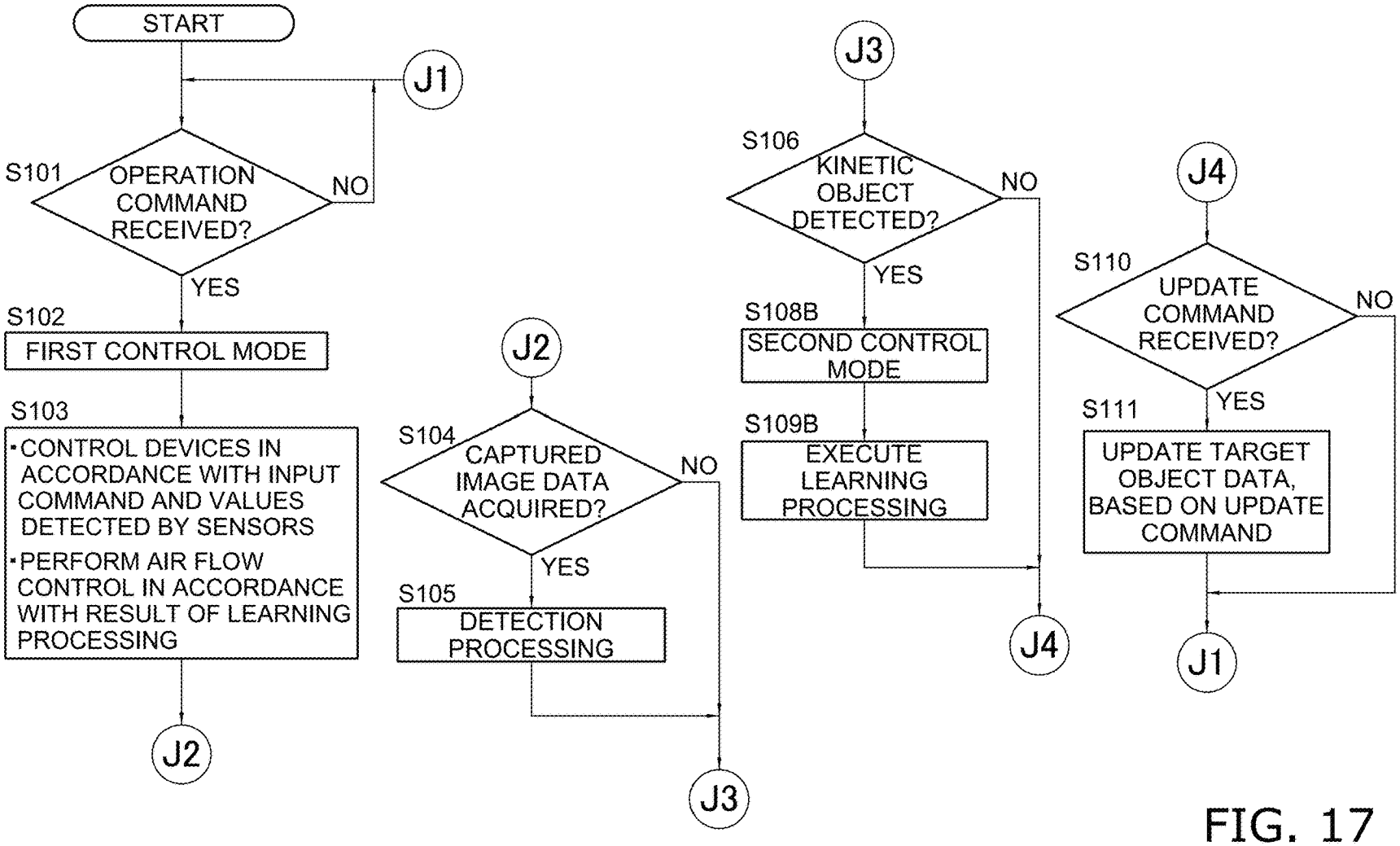
FIG. 17 is a flowchart of exemplary processing to be executed by the controller according to Modification 4.

For example, the controller 60 may execute the processing in accordance with a flowchart of FIG. 17 from which step S107 is omitted. In FIG. 17, steps S101 to S106, step S110, and step S111 are similar to those described in the first embodiment. In FIG. 17, steps S108B and S109B are carried out in place of steps S108 and S109.

In step S106 illustrated in FIG. 17, when the second detection section 632 detects no kinetic object X2 (NO in step S106), the processing proceeds to step S110. In step S106, when the second detection section 632 detects a kinetic object X2, and the determination section 633 determines the kinetic object X2 as a specific object X3 (YES in step S106), the processing proceeds to step S108B.

In step S108B, the controller 60 is placed in a second control mode. The second control mode in this case is a control mode in which the controller 60 is placed when a specific object X3 is detected in any one of the target spaces SP. The processing then proceeds to step S109B.

In step S109B, the controller 60 executes learning processing. The learning processing in this case is processing of, when the specific object X3 is detected in the target space SP, sending an air flow to the specific object X3 and learning about one of or both of a limit air flow direction and a limit air flow volume regarding the specific object X3. In other words, the learning processing in this case involves positively sending an air flow to an object OB that is moved by the air flow which the indoor unit 20 sends, irrespective of whether or not the object OB is a target object X1, and learning about one of or both of the limit air flow direction and the limit air flow volume regarding the object OB. In this learning processing, for example, the learning section 651 learns about the limit air flow direction or the limit air flow volume regarding the specific object X3 in such a manner that one of or both of the direction and the volume of the indoor air flow AF is or are controlled such that the air flow AF is sent by a predetermined volume to the specific object X3. In this learning processing, for example, the learning section 651 also learns about the limit air flow direction or the limit air flow volume regarding the specific object X3 which is the target object X1, as in a manner similar to that described in the first embodiment. The learning section 651 stores a result of the learning processing in learning data D8. The processing then proceeds to step S110.

In Modification 4, the specific object X3 is an object OB that is moved by an indoor air flow AF in a target space SP. In Modification 4, the specific object X3 is also an object OB that is possibly moved by an indoor air flow AF in a target space SP.

As described above, the controller 60 may be configured to detect, as a specific object X3, an object OB which is different from a target object X1. In other words, learning processing may be executed to learn about one of or both of a limit air flow direction and a limit air flow volume regarding an object OB which is different from a target object X1, but is moved by an air flow which the indoor unit 20 sends, and air flow control may be performed in accordance with a result of the learning.

(6-5) Modification 5

Figure 18:
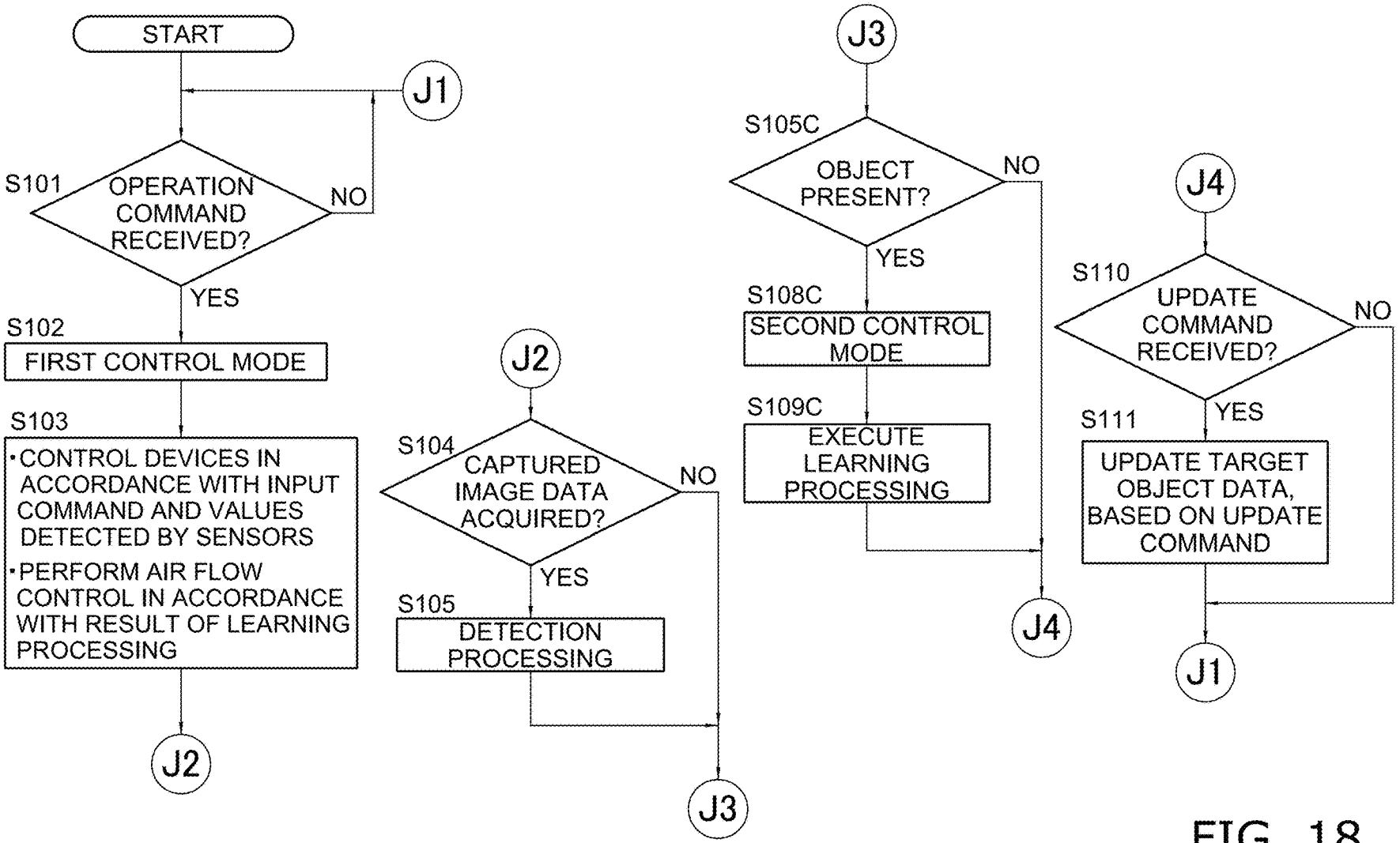
FIG. 18 is a flowchart of exemplary processing to be executed by the controller according to Modification 5.

For example, the controller 60 may execute the processing in accordance with a flowchart of FIG. 18 from which steps S106 and S107 are omitted. In FIG. 18, steps S101 to S105, step S110, and step S111 are similar to those described in the first embodiment. In FIG. 18, steps S108C and S109C are carried out in place of steps S108 and S109. Also in FIG. 18, step S105C is carried out between step S105 and step S108C.

In step S105C illustrated in FIG. 18, it is determined whether an object OB is present in any one of the target spaces SP, based on a result of detection processing. This determination may be made by, for example, the determination section 633. When no object OB is detected (NO in step S105C), the processing proceeds to step S110. When an object OB is detected (YES in step S105C), the processing proceeds to step S108C.

In step S108C, the controller 60 is placed in a second control mode. The second control mode in this case is a control mode in which the controller 60 is placed irrespective of whether or not an object OB detected in a target space SP is a target object X1 or a kinetic object X2. The processing then proceeds to step S109C.

In step S109C, the controller 60 executes learning processing. The learning processing in this case is processing of, when the object OB is detected in the target space SP, sending an air flow to the object OB and learning about one of or both of a limit air flow direction and a limit air flow volume regarding the object OB. In other words, the learning processing in this case involves positively sending an air flow to the object OB in the target space SP, irrespective of whether or not the object OB is a target object X1 and a kinetic object X2, and learning about one of or both of the limit air flow direction and the limit air flow volume regarding the object OB. In this learning processing, for example, the learning section 651 learns about the limit air flow direction or the limit air flow volume regarding the object OB in such a manner that one of or both of the direction and the volume of the indoor air flow AF is or are controlled such that the air flow AF is sent by a predetermined volume to the object OB which is different from the target object X1 and the kinetic object X2. In this learning processing, for example, the learning section 651 also learns about the limit air flow direction or the limit air flow volume regarding the object OB which is at least one of the target object X1 or the kinetic object X2, as in a manner similar to that described in the first embodiment or as in a manner similar to that described in Modification 3 or Modification 4. The learning section 651 stores a result of the learning processing in learning data D8. The processing then proceeds to step S110.

Also in the case where the learning processing is executed as described above, the device control section 65 performs air flow control in accordance with the limit air flow direction and the limit air flow volume regarding the object OB, based on the result of the learning processing. In Modification 5, the object OB detected in the target space SP is determined as a specific object X3 irrespective of whether or not the object OB is the target object X1 and the kinetic object X2. In Modification 5, the specific object X3 is an object OB that is possibly moved by an indoor air flow AF in a target space SP.

As described above, the controller 60 may be configured to detect, as a specific object X3, an object that cannot be detected as a target object X1 and a kinetic object X2 under a certain air flow condition, but is moved under a different air flow condition. The controller 60 may also be configured to extract, from characteristic data D7, a similar characteristic of an object registered as a target object X1 or a kinetic object X2, and detect, as a specific object X3, an object OB having a similar characteristic.

Learning processing may be executed to learn about one of or both of a limit air flow direction and a limit air flow volume regarding an object OB which is different from a target object X1 and a kinetic object X2, but is possibly moved by an air flow which an indoor unit 20 sends, and air flow control may be performed in accordance with a result of the learning.

In Modification 5, as in the first embodiment, the specific object X3 may be an object OB that is moved by an indoor air flow AF in a target space SP. In Modification 5, the specific object X3 may also be an object OB that is detected in the target space SP and is registered in advance as an object supposed to be moved by the indoor air flow AF.

(6-6) Modification 6

In the first embodiment, the specific object detection processing involves detecting a specific object X3 by detecting a kinetic object X2 with regard to an object OB detected based on captured image data D3 (kinetic object detection processing) and determining whether the kinetic object X2 is a registered target object X1 (specific object determination processing). However, how to detect a specific object X3 in the specific object detection processing is not necessarily limited thereto, and is changeable as appropriate. For example, the detection section 63 may directly detect a specific object X3 from captured image data D3. For example, the detection section 63 may detect a specific object X3 by directly extracting a target object X1 from captured image data D3 and detecting a state in which the target object X1 is moved to a degree that the target object X1 is supposed to be moved by an air flow which the indoor unit 20 sends. In other words, a specific object X3 may be directly extracted based on an operating state of an object OB in captured image data D3.

(6-7) Modification 7

The first embodiment describes the example in which the detection processing is executed by the method illustrated in FIG. 13. As a matter of course, however, the detection processing may be executed by another method. For example, the detection processing may be executed by any method in addition to the neural network. For example, a person PS and an object OB may be detected and identified in such a manner that characteristics of the person PS and the object OB registered by, for example, the administrator in advance are detected from captured image data D3, based on data defining the characteristics. The characteristic of the person PS or the object OB to be used in the detection processing is changeable as appropriate. The detection processing is not necessarily executed every time, but may be executed at predetermined timing. For example, the detection processing may be executed periodically (e.g., every 5 minutes). In the detection processing, a person PS is not necessarily detected, but only an object OB may be detected.

(6-8) Modification 8

In the first embodiment, the controller 60 is configured to control the operations of the devices in the air conditioner 10. Alternatively, the controller 60 may be configured to control only the devices performing the air flow-related operations. For example, the controller 60 may be configured to control one of or both of each indoor fan 21 and each flap 23.

(6-9) Modification 9

The data stored in each storage region of the storage section 61 may be defined as the control program stored in the program information storage region M1.

For example, target object data D2 is not necessarily stored in the target object information storage region M4. For example, target object data D2 may be defined as the control program in the program information storage region M1. In other words, the controller 60 may hold, as the control program, information identifying an object OB to be detected as a target object X1. For example, the controller 60 may hold, as the control program, information identifying a characteristic, such as a shape or a size, of an object OB to be detected as a target object X1.

For example, learning data D8 is not necessarily stored in the learning data storage region M11. For example, learning data D8 may be defined as the control program in the program information storage region M1. In other words, the controller 60 may hold, as the control program, a limit air flow volume and a limit air flow direction regarding a specific object X3 detected. For example, the controller 60 may hold, as the control program, at least one of a characteristic, such as a shape or a size, of a specific object X3 or a limit air flow volume and a limit air flow direction defined in accordance with a position of the specific object X3 or a distance from the corresponding blow-out port 22 to the specific object X3.

(6-10) Modification 10

In the first embodiment, the first detection section 631 is configured to learn about a characteristic of a person PS and a characteristic of an object OB, based on captured image data D3. However, the first detection section 631 is not necessarily configured as described above. Specifically, the first detection section 631 does not necessarily learn about a characteristic of a person PS or an object OB detected in the detection processing. The controller 60 may hold, as a control program, a table, or the like, information identifying a learned characteristic of a person PS or an object OB.

(6-11) Modification 11

In the first embodiment, captured image data D3 contains image data (moving image data) in which a predetermined range of each target space SP is represented by predetermined pixels. However, a format of captured image data D3 is changeable as appropriate in accordance with design specifications, an installation environment, and the like. For example, captured image data D3 may be image data (still image data) in which a predetermined range of each target space SP is represented by predetermined pixels.

(6-12) Modification 12

In the first embodiment, one image capturing unit 40 is installed in one target space SP. However, the installed state of an image capturing unit 40 is not necessarily limited thereto, but is changeable as appropriate. For example, a plurality of image capturing units 40 may be installed in one target space SP. In this case, an object OB or a person PS is recognized based on captured image data D3 obtained by each of the image capturing units 40. Since the detection processing is executed based on captured image data D3 containing images of the target space SP captured at different angles, an object OB or a person PS is detected accurately.

(6-13) Modification 13

In the first embodiment, each of the image capturing units 40 is provided in the indoor unit 20 designed to be embedded in the ceiling CI of the corresponding target space SP. However, the installed state of each image capturing unit 40 is not necessarily limited thereto, but is changeable as appropriate. For example, any of or all of the image capturing units 40 may be provided in indoor units 20 designed to be suspended from the ceilings of the target spaces SP or may be provided in indoor units 20 designed to be hung on the sidewalls SW of the target spaces SP. For example, any of or all of the image capturing units 40 are not necessarily provided in the indoor units 20, but may be provided in other devices or may be provided independently of the indoor units 20.

(6-14) Modification 14

In the first embodiment, the air conditioning system 100 is applied to the target facility 1 including the plurality of target spaces SP. However, the number of target spaces SP in the target facility 1 to which the air conditioning system 100 is applied is changeable as appropriate. For example, the air conditioning system 100 may be applied to a target facility including a single target space SP.

(6-15) Modification 15

In the first embodiment, the communication network between two units (e.g., between the outdoor unit control section 18 and any one of the indoor unit control sections 25, between any one of the indoor unit control sections 25 and any one of the indoor unit control sections 25, between any one of the indoor unit control sections 25 and any one of the remote controller control sections 35, between any one of the indoor unit control sections 25 and the corresponding image capturing unit 40) is established using the communication line. As a matter of course, however, a communication network between two units may be established by wireless communication using a radio wave or an infrared ray, in addition to the communication line or in place of the communication line. In addition, the devices, including the outdoor unit control section 18 and the server 50, may be connected to the wide area network NW1 by wireless communication, in addition to the communication lines or in place of the communication lines.

(6-16) Modification 16

In the first embodiment, the server 50 is configured to establish communications with the outdoor unit control section 18, the indoor unit control sections 25, and the remote controller control sections 35 via the wide area network NW1. Alternatively, the server 50 may be configured to establish communications with these units via a local area network (LAN).

(6-17) Modification 17

In the first embodiment, the controller 60 is constituted of the outdoor unit control section 18, the indoor unit control sections 25, the remote controller control sections 35, and the server 50 that are connected via the communication network. However, the configuration of the controller 60 is not necessarily limited thereto. For example, the controller 60 may have the following configurations. For example, with regard to the devices constituting the controller 60, any of the outdoor unit control section 18, the indoor unit control sections 25, the remote controller control sections 35, and the server 50 may be omitted. For example, the controller 60 may be constituted of any of or all of the outdoor unit control section 18, the remote controller control sections 35, and the indoor unit control sections 25. In this case, the air conditioner 10 includes the controller 60.

For example, the controller 60 may be constituted of other devices connected via the communication network, in place of or in addition to any of the outdoor unit control section 18, the indoor unit control sections 25, the remote controller control section 35, and the server 50. The controller 60 is not necessarily constituted of the devices connected via the wide area network NW1, but may be constituted only of devices connected via a LAN.

(6-18) Modification 18

In the first embodiment, the idea of the present disclosure is applied to the indoor units 20, each of which is a "fan", of the air conditioner 10. However, the idea of the present disclosure is applicable to other "fans" in addition to the indoor units 20 of the air conditioner 10. The "fans" to which the idea of the present disclosure is applicable are not particularly limited as long as they are devices configured to send an air flow. Examples of the "fans" may include an air cleaner, a dehumidifier, an electric fan, and a ventilator.

The main bodies of the "fans" are not necessarily installed in the target spaces SP. The "fans" may be provided to send air flows through ducts or the like. In other words, the places where the "fans" are installed are not limited as long as the blow-out ports in the "fans" communicate with the target spaces SP.

Second Embodiment

Next, a description will be given of a controller 60*a* and an air conditioning system 100*a* according to a second embodiment. This description mainly concerns a difference between the air conditioning system 100*a* according to the second embodiment and the air conditioning system 100 according to the first embodiment. In the following description, the contents not mentioned in the second embodiment are similar to those in the controller 60 or the air conditioning system 100 according to the first embodiment unless otherwise specified.

Figure 19:
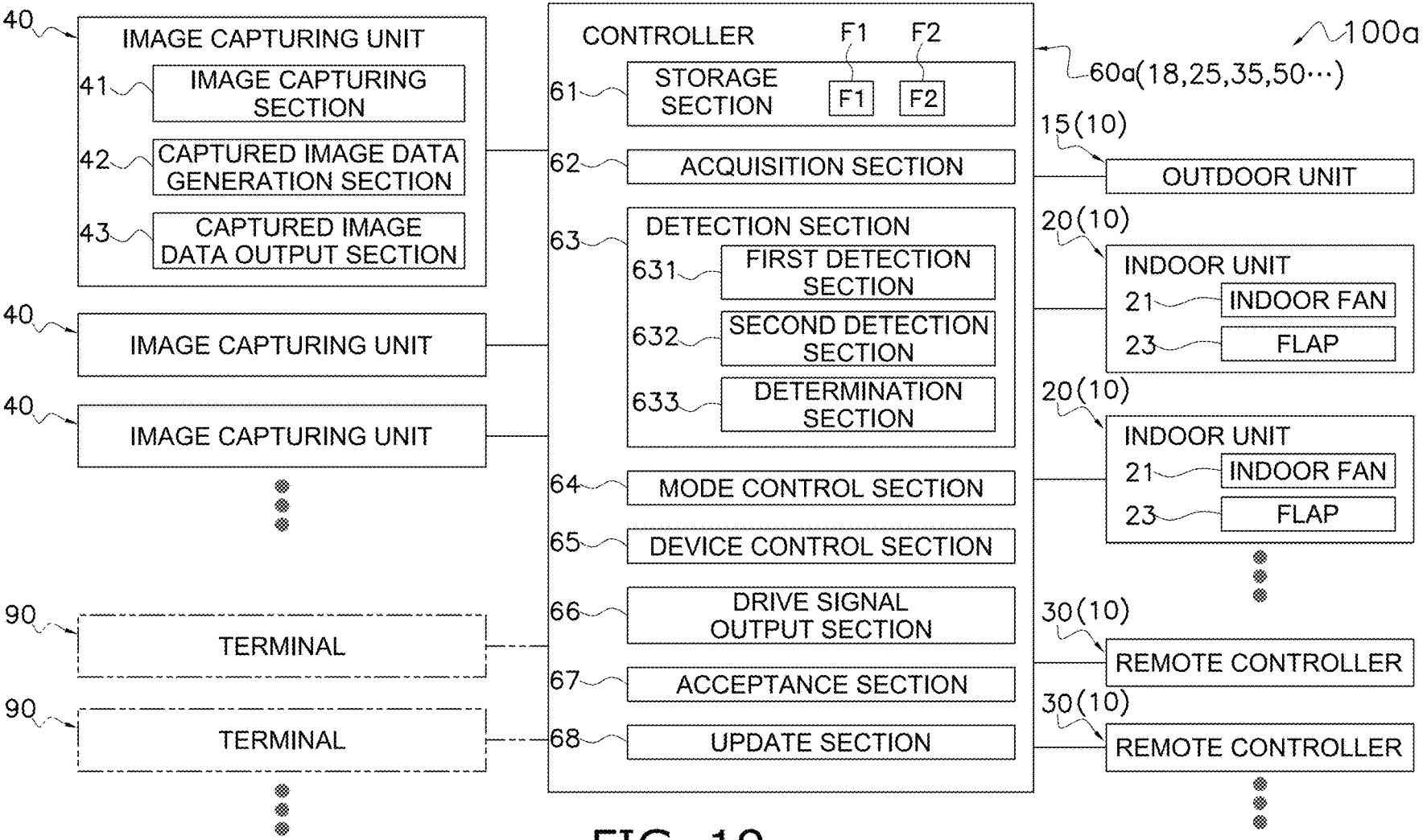
FIG. 19 is a block diagram of a schematic configuration of an air conditioning system according to a second embodiment.

FIG. 19 is a block diagram of a schematic configuration of the air conditioning system 100*a* (an air flow control system). The air conditioning system 100*a* (the air flow control system) includes the controller 60*a* in place of the controller 60. The controller 60*a* (an air flow control apparatus) is a control apparatus that manages the operation of the air conditioning system 100*a* in a centralized manner.

In the controller 60*a*, a storage section 61 has a learning data storage region M11 (FIG. 6) that stores learning data D8 individually identifying learned limit air flow directions and limit air flow volumes regarding objects OB that are possibly moved by an air flow which an indoor unit 20 sends. The learning data D8 contains information identifying the limit air flow directions and limit air flow volumes according to at least one of distances or positions of the objects OB relative to a blow-out port 22 in the indoor unit 20. The learning data D8 may contain, for each object, a plurality of limit air flow directions, a plurality of limit air flow volumes, and a plurality of combinations between the air flow directions and the limit air flow volumes.

In the controller 60*a*, unlike the first embodiment, a device control section 65 does not include a learning section 651. In the second embodiment, the device control section 65 performs air flow control (first processing) in a second control mode. In the second embodiment, the air flow control is processing of controlling one of or both of an indoor fan 21 and a flap 23 such that an indoor air flow AF is sent to a specific object X3 in a target space SP, in accordance with the limit air flow direction and the limit air flow volume defined in the learning data D8.

According to the second embodiment, in the second control mode, the device control section 65 performs the air flow control of controlling the volume of the indoor air flow AF to be sent to the specific object X3 such that the specific object X3 is inhibited from being moved.

Figure 20:
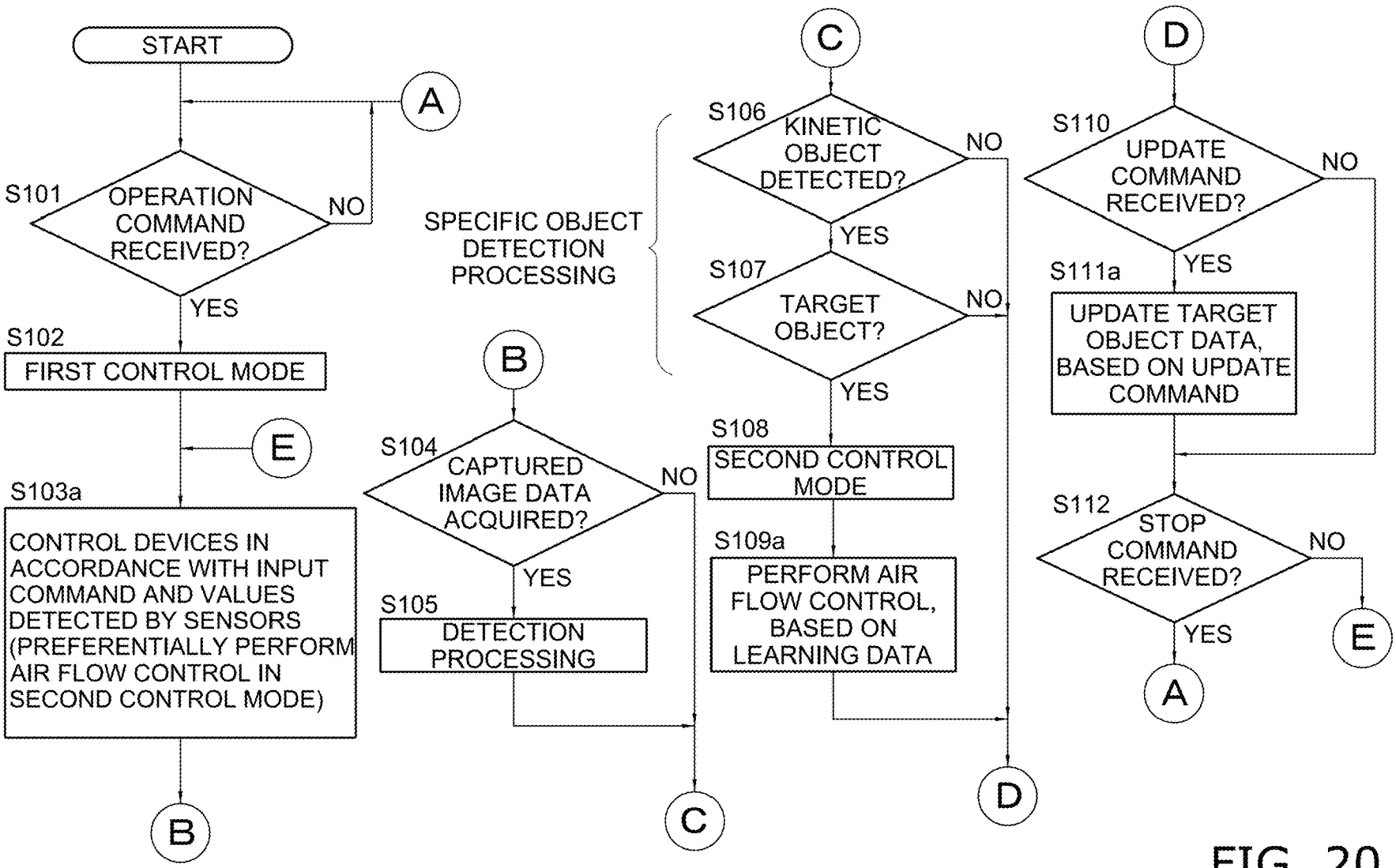
FIG. 20 is a flowchart of exemplary processing to be executed by a controller according to the second embodiment.

With reference to FIG. 20, next, a description will be given of exemplary processing to be executed by the controller 60*a*. FIG. 20 is a flowchart of the exemplary processing to be executed by the controller 60*a*.

The controller 60*a* sequentially carries out steps S101 to S112 illustrated in FIG. 20. The sequence of the processing illustrated in FIG. 20 is changeable as appropriate. For example, the order of the steps may be changed, some of the steps may be carried out simultaneously, or a step not illustrated in FIG. 20 may be added as long as the processing is executed correctly.

In FIG. 20, step S101, step S102, steps S104 to S108, and step S110 are similar to those described in the first embodiment (FIG. 14). In the second embodiment, steps S103*a*, S109*a*, and S111*a* are carried out in place of steps S103, S109, and S111 described in the first embodiment. In addition, step S112 is carried out.

In step S103*a*, the controller 60*a* (the device control section 65) controls states of devices in real time in accordance with a received command, set temperatures, and values detected by sensors, thereby causing an air conditioner 10 to perform an operation. In step S103*a*, the controller 60*a* preferentially performs the air flow control when the controller 60*a* is placed in the second control mode. The processing then proceeds to step S104.

In step S109*a*, the controller 60*a* (the device control section 65) performs the air flow control to inhibit an object OB detected as a specific object X3 from being moved, and controls a volume of an indoor air flow AF to be sent toward the object OB. Specifically, when an object OB detected as a specific object X3 is present in any one of the target spaces SP, the controller 60*a* controls one of or both of the indoor fan 21 and the flap 23 such that an air flow is sent toward the object OB, based on the limit air flow direction and the limit air flow volume in the learning data D8. The processing then proceeds to step S110.

In step S111*a*, the controller 60*a* (an update section 68) updates target object data D2, based on an update command received. The processing then proceeds to step S112.

In step S112, when the controller 60 receives no stop command instructing a stop of the operation (NO in step S112), the processing returns to step S103*a*. On the other hand, when the controller 60 receives a stop command instructing a stop of the operation (YES in step S112), the processing returns to step S101.

The second embodiment also achieves the matters described in "(5) Features" of the first embodiment. The air conditioning system 100*a* according to the second embodiment may also adopt by analogy the respective the ideas of Modifications 1 to 18 of the first embodiment, and these modifications are applicable in conjunction with other modifications insofar as there are no contradictions.

In the second embodiment, the controller 60*a* may execute processing in accordance with a flowchart different from that of FIG. 20. In the case where the controller 60*a* executes processing different from that illustrated in FIG. 20, processing to be executed by each functional section in the controller 60*a* is added or changed as appropriate.

Figure 21:
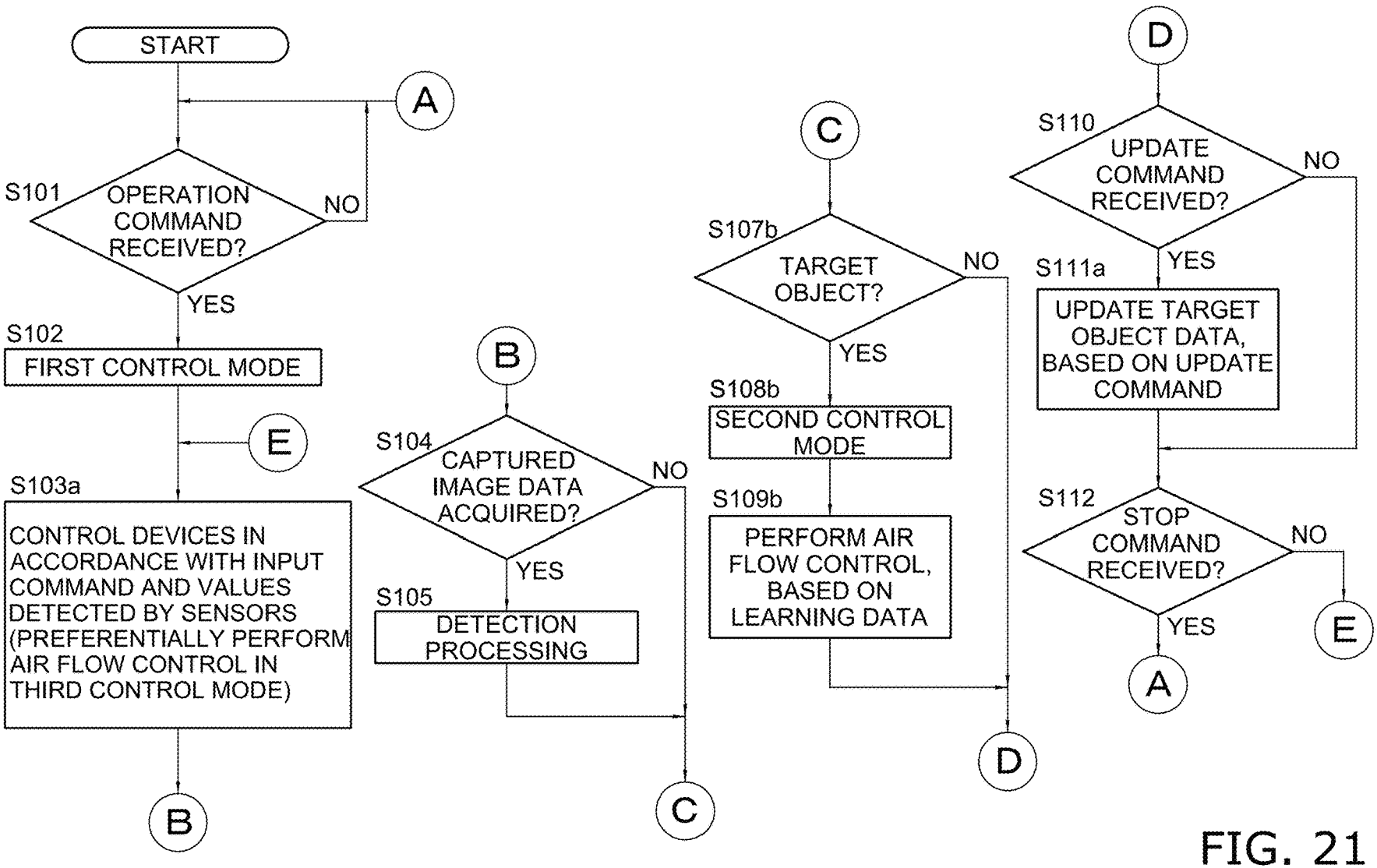
FIG. 21 is a flowchart of another exemplary processing to be executed by the controller according to the second embodiment.

For example, the controller 60*a* may execute processing in accordance with a flowchart of FIG. 21 from which step S106 is omitted, as in "(6-3) Modification 3" (FIG. 16) of the first embodiment.

Figure 22:
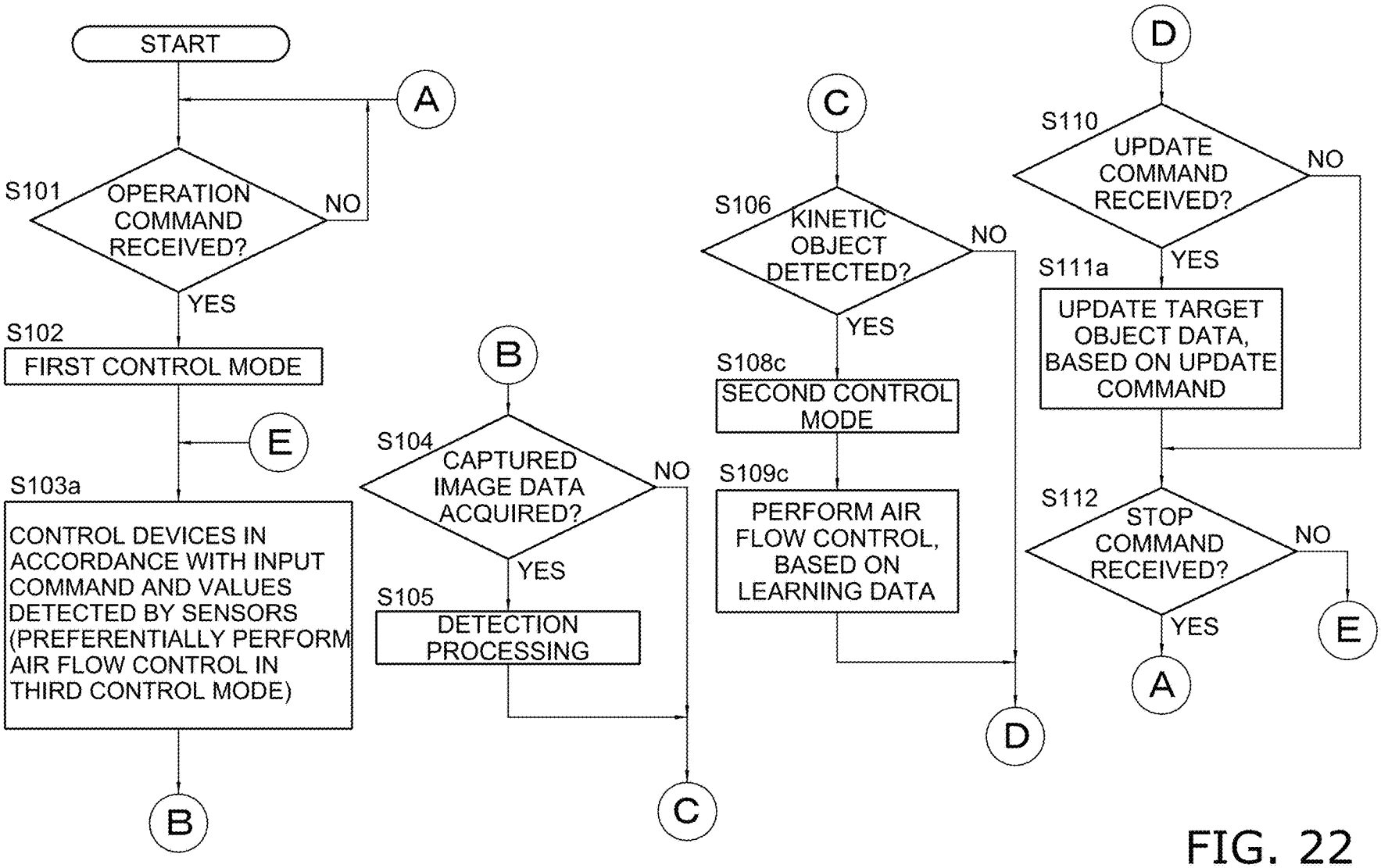
FIG. 22 is a flowchart of still another exemplary processing to be executed by the controller according to the second embodiment.

For example, the controller 60*a* may execute processing in accordance with a flowchart of FIG. 22 from which step S107 is omitted, as in "(6-4) Modification 4" (FIG. 17) of the first embodiment. In FIG. 22, steps S101 to S106, and steps S110 to S112 are similar to those illustrated in FIG. 20. In FIG. 22, steps S108*c* and S109*c* are carried out in place of steps S108 and S109*a*. In FIG. 22, step S108*c* is similar to step S108B described in "(6-4) Modification 4" (FIG. 17) of the first embodiment. In step S109*c*, the controller 60*a* performs air flow control (first processing), based on learning data D8.

Figure 23:
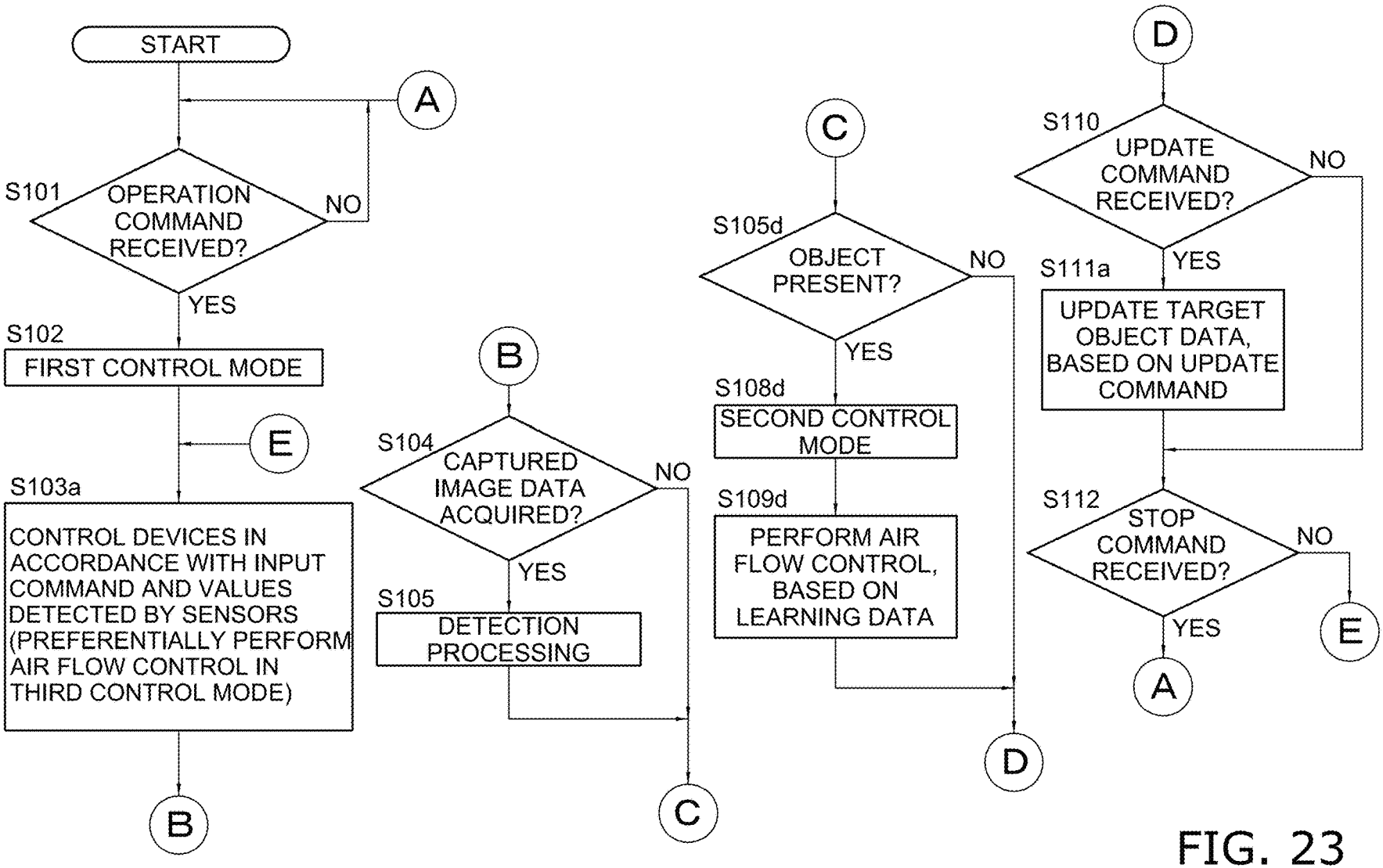
FIG. 23 is a flowchart of yet another exemplary processing to be executed by the controller according to the second embodiment.

For example, the controller 60*a* may execute processing in accordance with a flowchart of FIG. 23 from which steps S106 and S107 are omitted, as in "(6-5) Modification 5" (FIG. 18) of the first embodiment. In FIG. 23, steps S101 to S105, and steps S110 to S112 are similar to those illustrated in FIG. 20. In FIG. 23, steps S108*d* and S109*d* are carried out in place of steps S108 and S109*a*. Also in FIG. 23, step S105*d* is carried out between step S105 and step S108*d*. In FIG. 23, steps S105*d* and S108*d* are similar to steps S105C and S108C described in "(6-5) Modification 5" (FIG. 18) of the first embodiment. In step S109*d*, the controller 60*a* performs air flow control.

Also in the second embodiment, data stored in each storage region of the storage section 61 may be defined as a control program stored in a program information storage region M1.

For example, target object data D2 is not necessarily stored in a target object information storage region M4. For example, target object data D2 may be defined as the control program in the program information storage region M1. In other words, the controller 60*a* may hold, as the control program, information identifying an object OB to be detected as a target object X1. For example, the controller 60*a* may hold, as the control program, information identifying a characteristic, such as a shape or a size, of an object OB to be detected as a target object X1.

For example, learning data D8 is not necessarily stored in a learning data storage region M11. For example, learning data D8 may be defined as the control program in the program information storage region M1. In other words, the controller 60*a* may hold, as the control program, a limit air flow volume and a limit air flow direction regarding a specific object X3. For example, the controller 60*a* may hold, as the control program, at least one of a characteristic, such as a shape or a size, of a specific object X3 or a limit air flow volume and a limit air flow direction defined in accordance with a position of the specific object X3 or a distance from the blow-out port 22 to the specific object X3.

The controller 60*a* is not necessarily constituted of the devices connected via a wide area network NW1, but may be constituted of any of or all of an outdoor unit control section 18, indoor unit control sections 25, and remote controller control sections 35. In other words, the controller 60*a* may be constituted of only devices installed in a target facility 1 or a target space SP. In addition, each indoor unit 20 may hold, at its indoor unit control section 25, learning data D8 as a control program, a table, or the like.

While various embodiments have been described herein above, it is to be appreciated that various changes in form and detail may be made without departing from the spirit and scope presently or hereafter claimed.

The present disclosure is applicable to an air flow control apparatus, an air conditioner, or an air flow control system.

100, 100*a*: air conditioning system (air flow control system)
631: first detection section
632: second detection section
633: determination section
651: learning section
AF: indoor air flow (air flow)
CI: ceiling
D1: image capturing unit installation data
D2: target object data (object information)
D3: captured image data (image data)
D4: detection data
D5: kinetic object data
D6: specific object data
D7: characteristic data
D8: learning data
F1: kinetic object flag
F2: control mode flag
NW1: wide area network
OB: object
PS: person
SP: target space
TB1: image capturing unit table
TB2: target object table
TB3: detection table
TB4: kinetic object table TB5: specific object table
TB6: air flow volume table
X1: target object
X2: kinetic object
X3: specific object
cb1-cb4: communication line

CITATION LIST

Patent Literature

Patent Literature 1: JP 2018-76974 A

What is claimed is:

1. An air flow control apparatus for controlling a fan, the air flow control apparatus comprising:
an acquisition section configured to acquire image data obtained by an image capturing device installed in a target space;
a detection section configured to detect a specific object movable by an air flow sent from the fan, based on the image data acquired by the acquisition section;
a control section configured to execute first processing, the first processing including controlling at least one of a direction and a volume of the air flow sent from the fan, based on a result of detection by the detection section; and
a storage section configured to store learning data individually identifying a limit air flow direction/limit air flow volume as to the specific object detected in the target space, the limit air flow direction/limit air flow volume being a direction of an air flow by which the specific object is inhibited from being moved, a volume of an air flow by which the specific object is inhibited from being moved, or a combination of the direction and the volume,
the first processing including controlling, when the specific object is present in the target space, at least one of the direction and the volume of the air flow sent from the fan such that the specific object is not moved by the air flow sent from the fan, based on the limit air flow direction/limit air flow volume in the learning data.

2. The air flow control apparatus according to claim 1, wherein
the first processing includes reducing the volume of the air flow sent from the fan to the specific object.

3. The air flow control apparatus according to claim 2, wherein
the detection section is further configured to detect a position of the specific object relative to the fan.

4. The air flow control apparatus according to claim 2, further comprising:
a storage section configured to store object information on the specific object,
the detection section being further configured to detect the specific object, based on the object information stored in the storage section.

5. The air flow control apparatus according to claim 2, wherein
the detection section further is further configured to detect a person in the target space, based on the image data acquired by the acquisition section.

6. The air flow control apparatus according to claim 1, wherein
the detection section is further configured to detect a position of the specific object relative to the fan.

7. The air flow control apparatus according to claim 6, wherein
the detection section detects a distance between the fan and the specific object.

8. The air flow control apparatus according to claim 6, further comprising:
a storage section configured to store object information on the specific object,
the detection section being further configured to detect the specific object, based on the object information stored in the storage section.

9. The air flow control apparatus according to claim 1, further comprising:
the storage section configured to store object information on the specific object,
the detection section being further configured to detect the specific object, based on the object information stored in the storage section.

10. The air flow control apparatus according to claim 9, wherein
the specific object includes at least one of paper, cloth, fiber, ash, soot, dust, and dirt.

11. The air flow control apparatus according to claim 9, further comprising:
a learning section configured to learn about the first processing,
the learning section being configured to learn about at least one of the direction and the volume of the air flow by which the specific object is inhibited from being moved, based on a result of the first processing executed.

12. The air flow control apparatus according to claim 9, further comprising:
an update section configured to update the object information.

13. The air flow control apparatus according to claim 1, wherein
the detection section further is further configured to detect a person in the target space, based on the image data acquired by the acquisition section.

14. An air conditioner including the air flow control apparatus according to claim 1.

15. An air flow control system including the air flow control apparatus according to claim 1, the air flow control system further comprising:
the fan; and
the image capturing device installed in a target space.

* * * * *